US009943748B2

(12) United States Patent
Azzolin et al.

(10) Patent No.: US 9,943,748 B2
(45) Date of Patent: Apr. 17, 2018

(54) SKATE BLADE SYSTEM WITH DYNAMIC MOVEMENT

(71) Applicant: Bladetech Hockey Inc., Ajax (CA)

(72) Inventors: Jeffrey Daniel Bruno Azzolin, Ajax (CA); John Joseph McPhee, Waterloo (CA)

( * ) Notice: Subject to any disclaimer, the term of this patent is extended or adjusted under 35 U.S.C. 154(b) by 0 days.

(21) Appl. No.: 14/772,582

(22) PCT Filed: Mar. 12, 2014

(86) PCT No.: PCT/CA2014/050220
§ 371 (c)(1),
(2) Date: Sep. 3, 2015

(87) PCT Pub. No.: WO2014/138977
PCT Pub. Date: Sep. 18, 2014

(65) Prior Publication Data

US 2016/0001162 A1 Jan. 7, 2016

Related U.S. Application Data

(60) Provisional application No. 61/784,436, filed on Mar. 14, 2013.

(51) Int. Cl.
*A63C 1/28* (2006.01)
*A63C 1/30* (2006.01)

(52) U.S. Cl.
CPC . *A63C 1/28* (2013.01); *A63C 1/30* (2013.01)

(58) Field of Classification Search
CPC .... A63C 1/00; A63C 1/28; A63C 1/30; A63C 1/32; A63C 1/24
See application file for complete search history.

(56) References Cited

U.S. PATENT DOCUMENTS

| | | | | |
|---|---|---|---|---|
| 27,015 A * | 1/1860 | Wicks | A63C 1/28 280/11.15 |
| 1,097,875 A * | 5/1914 | Pierce | A63C 1/30 280/11.12 |
| 1,789,182 A * | 1/1931 | Klevstad | A63C 1/24 280/11.15 |
| 2,131,569 A * | 9/1938 | Reitan | A63C 1/00 280/11.16 |
| 4,993,725 A | 2/1991 | Barnes et al. | |

(Continued)

FOREIGN PATENT DOCUMENTS

| | | |
|---|---|---|
| CA | 2324724 | 4/2002 |
| GB | 2477725 | 8/2011 |
| WO | 2007061229 | 5/2007 |

OTHER PUBLICATIONS

Canadian Intellectual Property Office as International Searching Authority, International Search Report and Written Opinion for PCT/CA2014/050220, dated May 30, 2014.

*Primary Examiner* — Brian L Swenson
(74) *Attorney, Agent, or Firm* — Gowling WLG (Canada) LLP; Jeffrey Wong

(57) ABSTRACT

The disclosure is directed at a skate blade system including a boot portion; a blade housing, mounted to a bottom of the boot portion; and a blade portion having a heel and a toe end; wherein the blade portion is fastened at the heel end to the blade housing in a fixed relationship and is unattached from the blade portion blade housing at the toe end.

18 Claims, 26 Drawing Sheets

(56) References Cited

U.S. PATENT DOCUMENTS

| | | | | |
|---|---|---|---|---|
| 5,257,793 | A * | 11/1993 | Fortin | A63C 1/00 280/11.12 |
| 5,842,706 | A | 12/1998 | Chang | |
| 5,971,405 | A * | 10/1999 | Edauw | A63C 1/22 280/11.14 |
| 6,419,241 | B1 * | 7/2002 | Chenevert | A63C 1/02 280/11.14 |
| 7,419,187 | B2 * | 9/2008 | Haugen | A63C 1/28 280/11.224 |
| 8,770,595 | B2 * | 7/2014 | Cruikshank | A63C 1/22 280/11.14 |
| 2002/0175481 | A1 * | 11/2002 | Steinhauser, Jr. | A63C 1/32 280/11.18 |

* cited by examiner

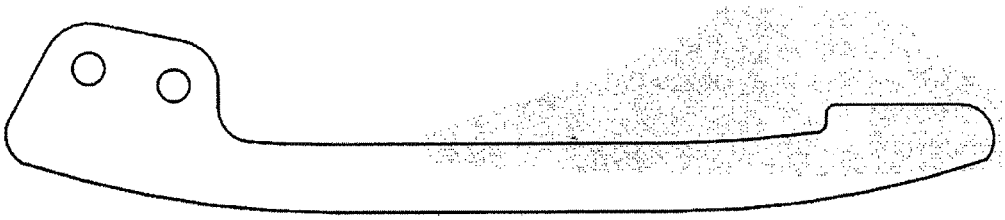
Figure 16a (Heavy users)
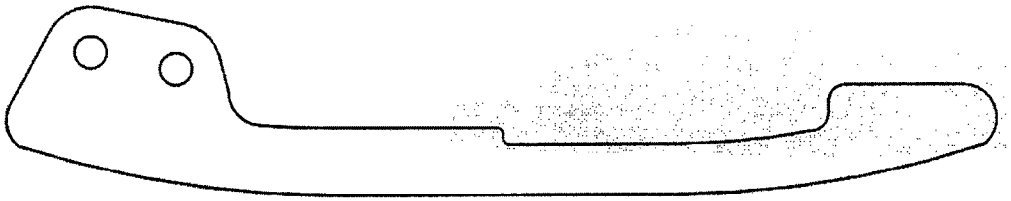
Figure 16b (Average users)
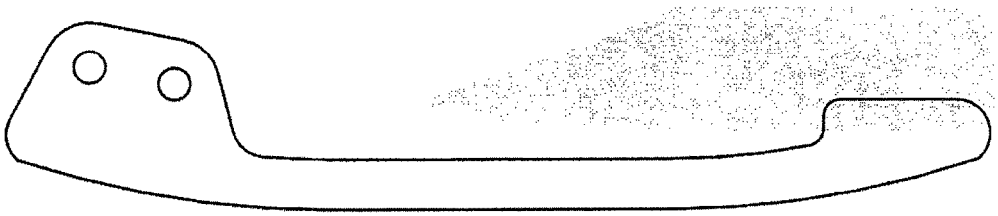
Figure 16c (Light users)

SKATE BLADE SYSTEM WITH DYNAMIC MOVEMENT

CROSS-REFERENCE TO RELATED APPLICATIONS

This application claims the benefit of U.S. Provisional Application No. 61/784,436 filed Mar. 14, 2013 which is hereby incorporated by reference in its entirety.

FIELD OF THE DISCLOSURE

The current disclosure is generally directed at skates and more specifically, the current disclosure is directed at a skate blade system with dynamic movement.

BACKGROUND OF THE DISCLOSURE

Skates, such as figure skates, hockey skates or roller skates, are commonly used by individuals who either compete in ice sports or wish to exercise. With ice skates, such as hockey or figure skates, the users glide along an ice surface to move from one location to the next. For roller skates, the users typically skate along a smooth surface although other surfaces may be traversed.

The technology behind skates has been ever improving, however, many companies developing and selling skates have been focusing on increasing skating speed by reducing the weight of their skates.

The main drawback to this strategy is that limits are being reached in mechanical strength and weight of the utilized materials. For example, two millimeters of carbon fiber may offer the same strength as four millimeters of plastic and weigh half the amount. However, there may not be adequate material that can be used to replace carbon fiber for increased weight reduction in subsequent designs. As a result the required strength and thicknesses of skate materials are being pushed to their limits, leaving little room for optimization in subsequent models. This transition to significantly lighter materials has also resulted in a more expensive product for the customer. Many companies developing and selling skates have been focusing on increasing skating speed by reducing the weight of their skates.

Therefore, there is provided a novel skate blade system with dynamic movement.

SUMMARY OF THE DISCLOSURE

The disclosure is directed at a skate system with dynamic movement.

In one embodiment, the disclosure is directed at a skate system which may increase skating speed through a more efficient usage of the skater's energy. In this embodiment, the disclosed skate system stores a portion of the user's input energy which would otherwise be lost in cracking the ice or dissipated through the user's joints and then provides the stored energy back to the skater in order to help propel them in the desired direction. One advantage of this system is that less input energy from the user will be converted into wasted energy and the user's skating technique may become more efficient.

In another embodiment, the skate system generates longer contact durations between the blade portion and the ice surface due to the deflection of energy storage within the skate system. This increased contact time will result in a greater change in momentum.

In a further embodiment, the skate system absorbs impacts to reduce joint damage by storing impact energy and later supplying the stored energy as a propulsive force. In a preferred embodiment, the disclosed skate system reduces joint damage by absorbing a portion of the impact energy generated when the user's foot comes into contact with the ice surface. Through absorbing a portion of this impact, less energy will be transmitted and dissipated through the user's joints. The skate system may also utilize the stored impact energy to propel the user forward as their foot leaves the ice surface and the device is unloaded (where the blade is no longer in contact with the ice surface).

In one aspect of the disclosure, there is provided a skate system which improves skating speed while providing impact absorption to reduce joint damage and player fatigue in a safe and reliable manner.

In another aspect, the disclosure provides a skate system which is as safe as current skates and is able to withstand vertical forces from a skater's feet impacting the ice surface, lateral forces from a skater attempting to stop and turn, and longitudinal forces generated by friction resistance and hitting bumps in the ice surface.

In another aspect, there is provided a skate system which requires little or no maintenance whereby the skate blade is easy to detach and reattach to the blade housing, or skate blade holder, should it ever need replacing.

In yet a further embodiment, there is provided a skate blade system including a boot portion; a blade housing, mounted to a bottom of the boot portion; and a blade portion having a heel and a toe end; wherein the blade portion is fastened at the heel end to the blade housing in a fixed relationship and is not engaged in a fixed relationship to the blade housing at the toe end.

BRIEF DESCRIPTION OF THE DRAWINGS

Embodiments of the present disclosure will now be described by way of example only, with reference to the attached Figures.

FIGS. 16*a* to 16*c* are side views of further embodiments of blade portions for use with the cantilever embodiment.

DETAILED DESCRIPTION OF THE EMBODIMENTS

The current disclosure is directed at a skate blade system with dynamic movement. The skate blade system includes a skate having a boot portion and a blade portion. The blade portion is connected to the boot portion via a mechanical mechanism that allows for dynamic movement of the blade portion with respect to the boot portion when the skate is in use. More specifically, the blade portion is housed within a blade housing located at a bottom of the boot portion as will be described below. In a preferred embodiment, the blade portion is easily accessible when the skate is not in use which also allows for simple blade removal or attachment.

Figure 1:
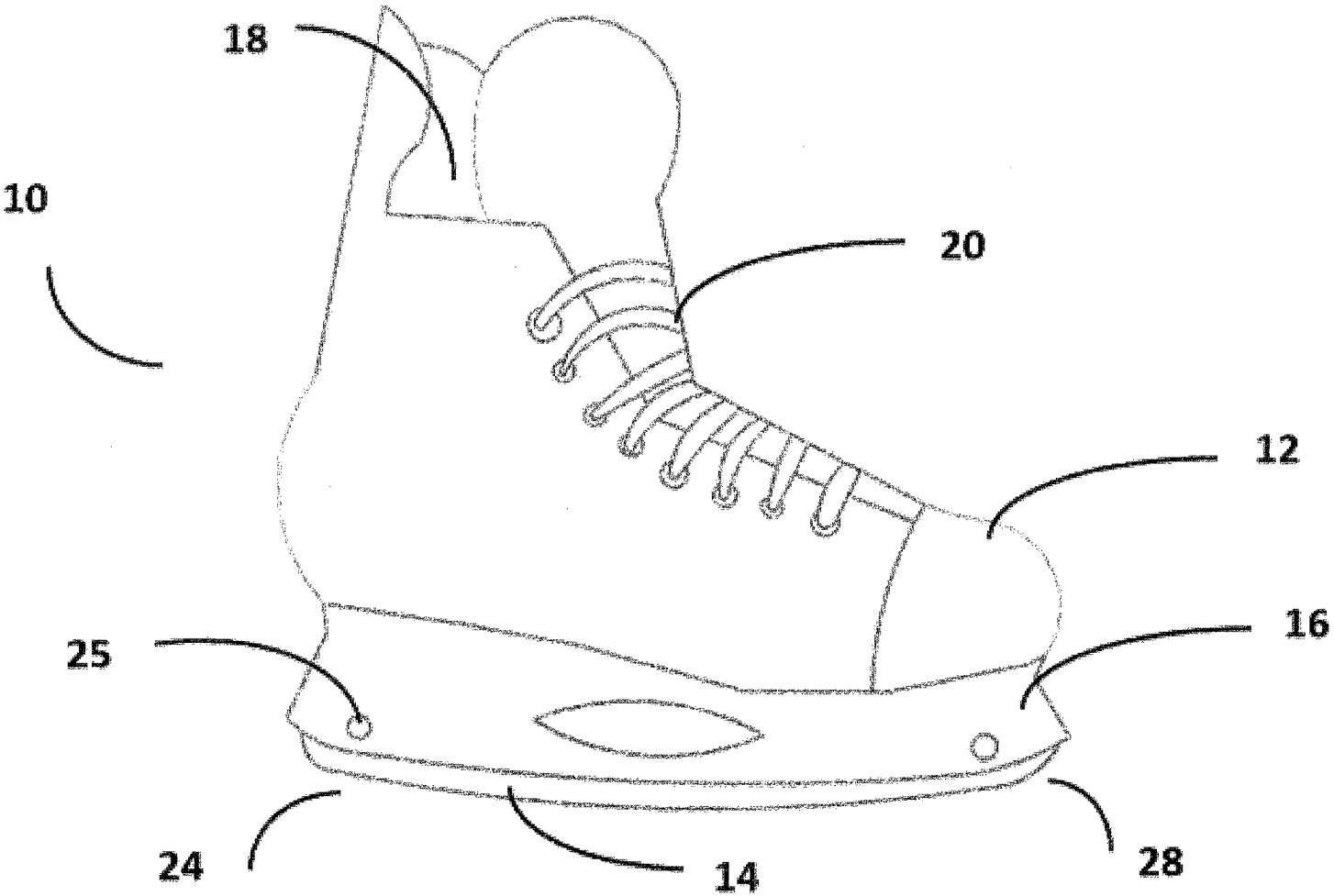
FIG. 1 is perspective view of a hockey skate.

Turning to FIG. 1, a schematic drawing of a skate is shown. A skate 10 generally includes a boot portion 12 and a blade portion 14. The blade portion 14 is housed within a blade housing, or blade holder, 16 which is mounted to or integrated with a bottom of the boot portion 12. The blade portion 14 includes a heel end 24 and a toe end 28.

As shown in FIG. 1, the blade portion 14 is fastened to the blade housing 16 via a set of fasteners 25, such as screws. This will be described in more detail below. The boot portion 12 further includes an opening 18 for receiving the foot of a user and may be tightened up via laces 20.

In current technology, the majority of hockey skate manufacturing companies utilize two different designs to attach the blade portion 14 to the blade housing 16.

Figure 10:
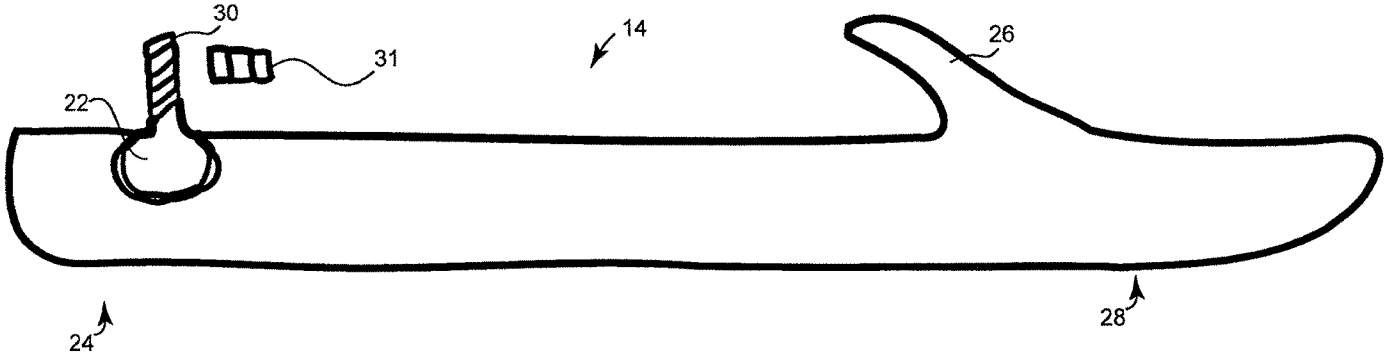
FIG. 10 is a schematic side view of a prior art blade portion.

In a first design (as shown in FIG. 10), the blade portion 14 includes an eye hole 22 at the heel end 24 and a diagonal protrusion 26 at the toe end 28. The eye hole 22 allows for a fastener 30, such as a key mechanism, to fit into the blade portion 14. In the preferred embodiment, the key mechanism is threaded to allow a nut 31 to connect the blade portion 14 to the blade housing 16 and thereby reduce or prevent vertical movement of the blade portion 14 within the blade housing 16. The diagonal protrusion 26 at the toe end 28 acts as a mechanical stoppage which reduces or prevents relative motion between the blade housing 16 and the blade portion 14. The diagonal protrusion 26 preferably slots into a corresponding slot within the blade housing 16.

Figure 11:
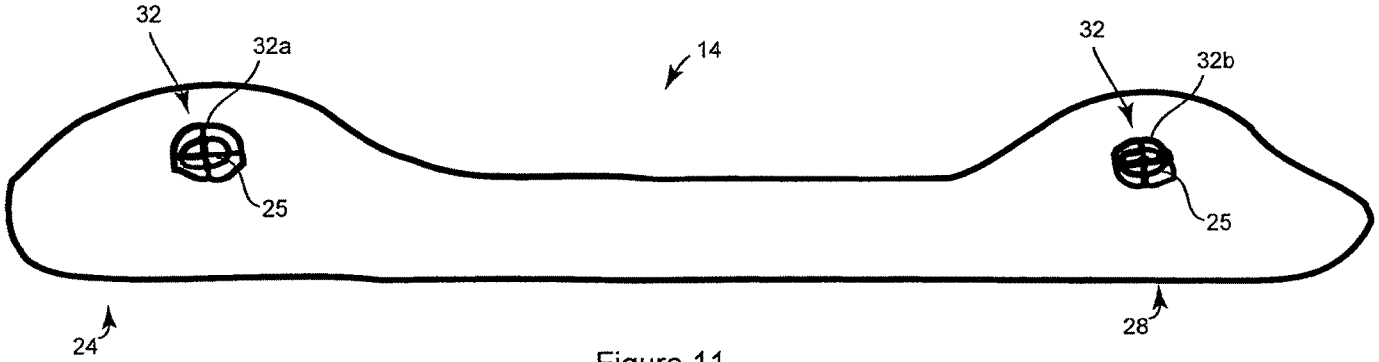
FIG. 11 is a schematic side view of another prior art blade portion.

In a second design, as schematically shown in FIG. 11, the blade portion 14 includes a pair of through holes 32; one 32*a* located at the heel end 24 and another 32*b* located at the toe end 28. These holes 32 receive fasteners 25 to secure the blade portion 14 to or within the blade housing 16 (such as shown in FIG. 1).

Figure 2:
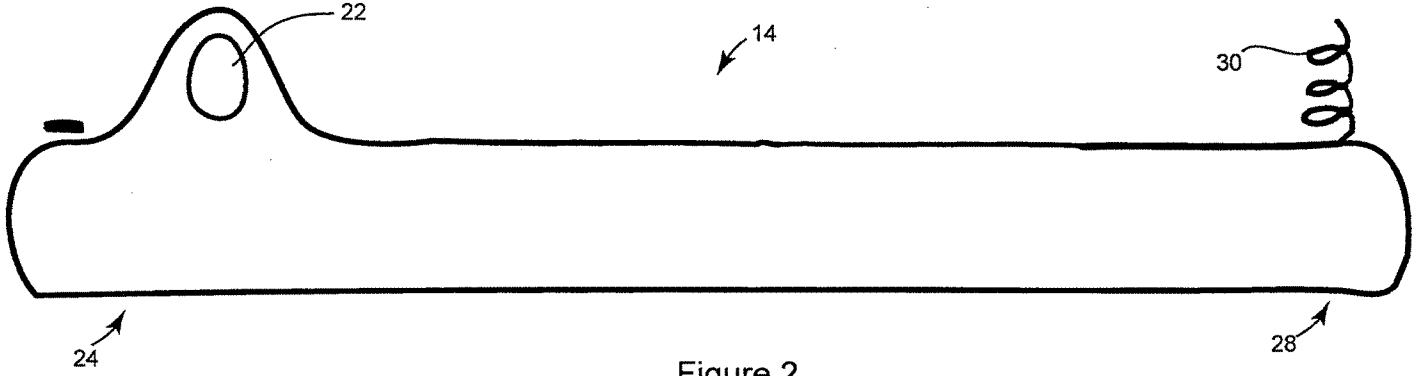
FIG. 2 is a schematic side view of a blade portion of the skate of FIG. 1 in accordance with an embodiment of the current disclosure.

Turning to FIG. 2, a schematic diagram of a blade portion for use with the skate of FIG. 1 is shown. This embodiment may be referred to as a spring mechanism embodiment. The blade portion 14 includes a hole 22 at the heel end 24 end and a spring portion 30 at the toe end 28. The spring portion 30 forms a part of a spring mechanism. The blade portion 14 may be attached to the blade housing 16 via the hole 22 via a fastener (not shown) such that the blade portion is fixed to the blade housing and the hole 22 acts as a pivot point when the skate is in use allowing the blade portion 14 to move, or rotate, with respect to the blade housing 16. In the current embodiment, the spring mechanism 30 is mounted on or attached to the blade portion 14 (at the toe end 28) with an adaptor (not shown). This will be described in more detail below. In FIG. 2, the spring portion 30 is shown as a metallic compression spring, however, the spring portion 30 may also be a set of Belleville washers mounted in a specific pattern to provide the needed spring rating or a polymeric material with a desired durometer.

When the skate is loaded such that the user is applying pressure on the blade portion 14 such as during use, the blade portion 14 rotates and compresses the spring portion 30 thereby storing mechanical energy within the spring portion 30. When the skate is unloaded such that the user is not applying pressure on the blade portion 14, the spring portion 30 will return to its equilibrium position and use the stored energy to propel the user in the desired direction.

One advantage of the spring mechanism embodiment is that energy and fatigue calculations are easy to calculate, especially if a metallic compression spring is used as the spring mechanism.

Figure 3:
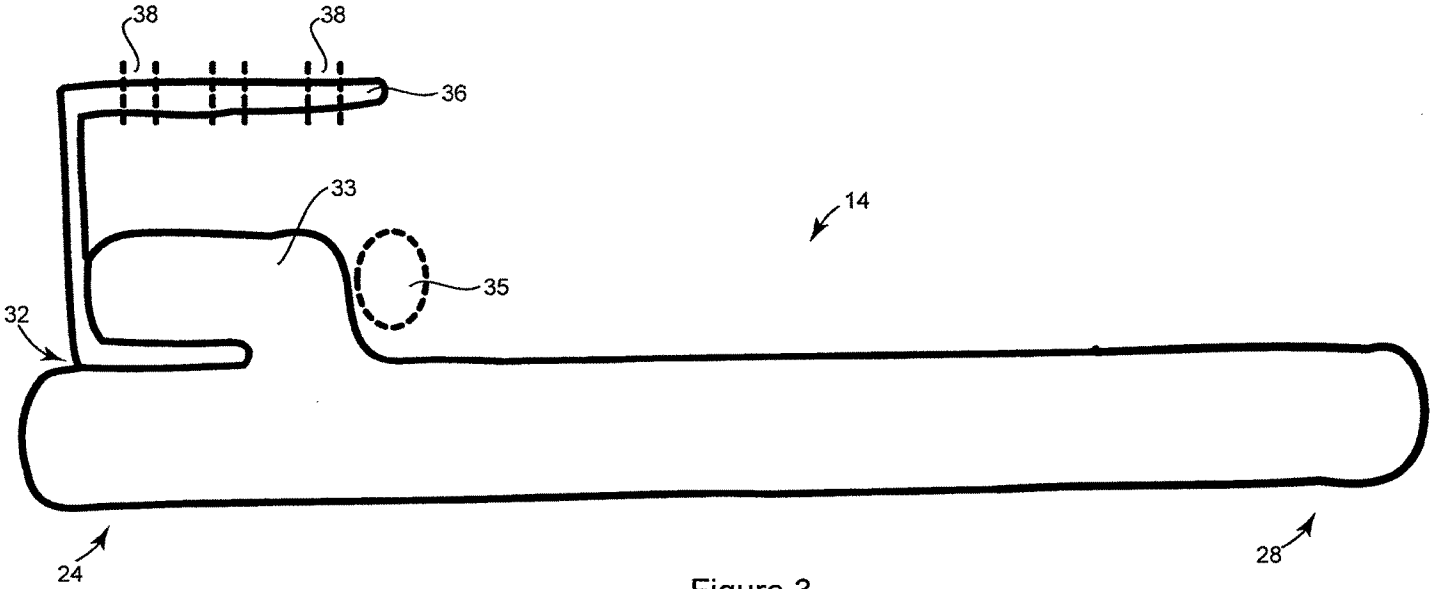
FIG. 3 is a schematic side view of a blade portion of the skate of FIG. 1 in accordance with another embodiment of the current disclosure.

Turning to FIG. 3, another schematic diagram of a blade portion for use with the skate of FIG. 1 is shown. This embodiment may be referred to as a bending bracket embodiment. In the current embodiment, the blade portion 14 includes a groove 32, produced by a tab portion 33, at the heel end 24 of blade portion 14. The toe end 28 of the blade portion 14 may be fixed or mounted to the blade housing (not shown) using any known methods or fasteners. As shown in dotted lines, adjacent the tab portion 33, a hole 35 within the blade housing receives a fastener (not shown) against which the tab portion 33 of the blade portion 14 abuts so that it does not accidentally slide out from the blade housing 16.

In the current embodiment, a bracket 36 includes one end which slides into the groove 32 and a second end which is secured to a bottom of the blade housing via fasteners 38 (shown in dotted lines in FIG. 3) through corresponding holes in the bracket. When the skate is loaded, the bracket 36 will deflect and store mechanical energy and when the skate is unloaded, the bracket 36 will spring back to its equilibrium position and the stored energy will provide a propulsive force to the user. One advantage of this embodiment is that its manufacture is relatively simple.

Figure 4:
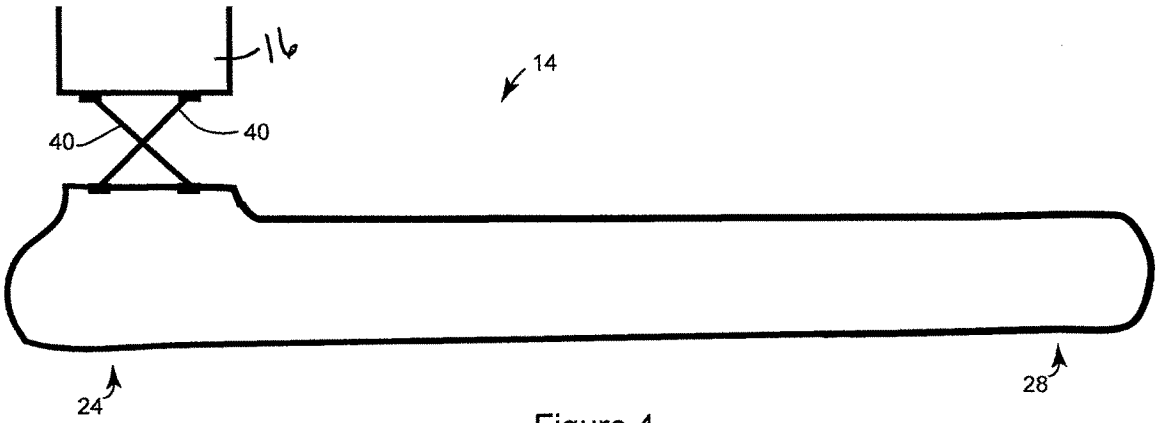
FIG. 4 is a schematic side view of a blade portion of the skate of FIG. 1 in accordance with a further embodiment of the current disclosure.

Turning to FIG. 4, another schematic diagram of a blade portion is shown. This embodiment may be referred to as a cross flexure joint embodiment. The blade portion 14 includes a pair of crossed struts 40 which fix the blade portion 14 to the blade housing 16 but also create a pivoting motion when the skate is loaded. In a preferred embodiment, the struts are manufactured from a material such as, but not limited a metallic material such as, but not limited to, steel, aluminum or titanium. The two struts 40 are attached to both the blade portion 14 and blade housing 16 at a heel end 24 of the blade portion 14. When the skate is loaded the struts 40 will typically bend to create the pivoting motion. The mechanical energy stored in the struts 40 will be provided to back the user when the skate in unloaded.

The advantages of the cross flexure joint embodiment include, but are not limited to, the fact that the pivoting motion can be achieved through the deflection of two fixed struts such that the design does not need lubrication.

Figure 5:
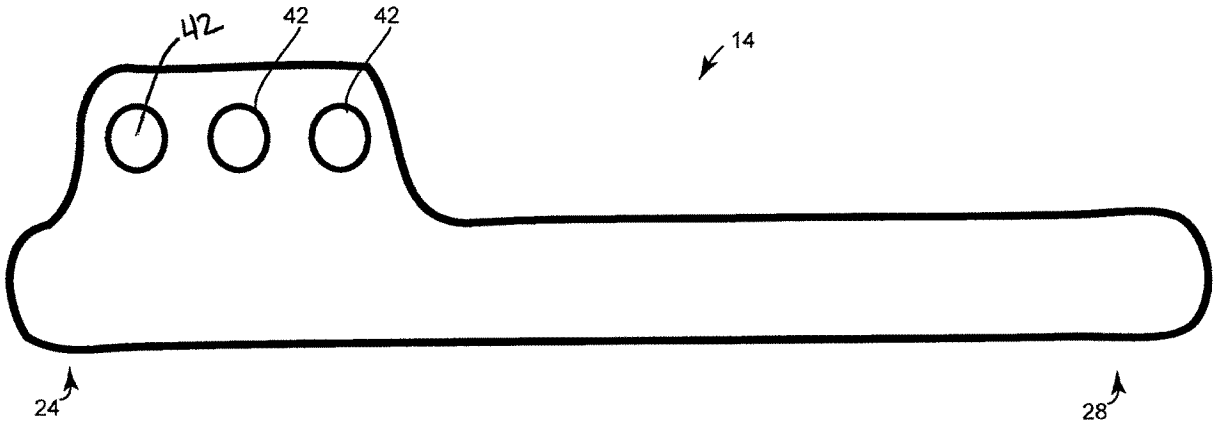
FIG. 5 is a schematic side view of a blade portion of the skate of FIG. 1 in accordance with another embodiment of the current disclosure.

Turning to FIG. 5, a schematic diagram of yet a further embodiment of a blade portion is shown. This embodiment may be seen as a cantilever embodiment. The blade portion 14 includes a set of holes 42 at the heel end 24 through which the blade portion 14 is connected to the blade housing (not shown). For instance, each of the holes 42 may receive a fastener allowing the blade portion 14 to be fixed to or mounted within the blade housing. The toe end 24 of the blade portion 14 is not directly connected to the blade housing but may be initially located or positioned within a slot in the housing. In this embodiment, the blade portion may act as a cantilever beam which allows the profile of the blade portion to deflect and store mechanical energy when the skate is loaded. Through fixing a portion of the blade portion (via the holes 42) to the blade housing, the unfixed portions will deflect when the skate is loaded. The deflection of the beam will be proportional to the cross sectional area, the moment of inertia, and material properties. When unloaded, the blade portion springs back to its original position and the stored mechanical energy will be used to propel the user in the desired direction. In the preferred embodiment, the blade housing is designed such that the blade portion remains within the slot.

Advantages of this design include, but are not limited to, easier maintenance and serviceability of the components when repair is necessary. Also, through simple loosening a couple fasteners (integrating the blade portion and the blade housing), the blade portion can be quickly and easily detached. The deflection of the blade can also be modeled in finite element method programs to estimate the blade deflection. Finally, various blade profiles can be created for different skate users.

Figure 6:
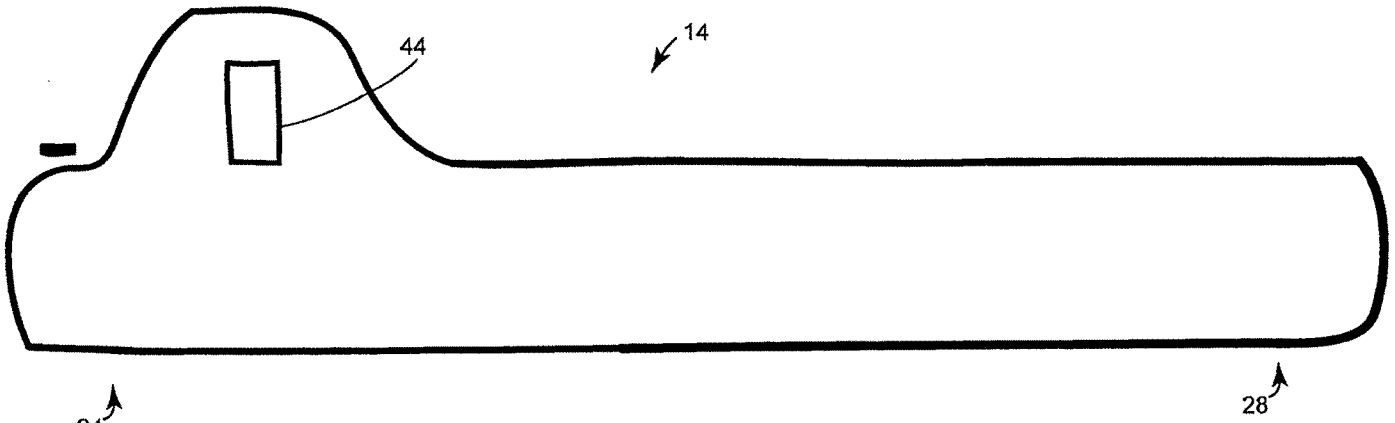
FIG. 6 is a schematic side view of a blade portion of the skate of FIG. 1 in accordance with a further embodiment of the current disclosure.

Turning to FIG. 6, a schematic diagram of yet a further embodiment of a blade portion is shown. The current embodiment may be referred to as a spring pin embodiment. In this embodiment, the blade portion 14 includes a hole 44. The system may further include a fastener mechanism which undergoes torsion and shear to store mechanical energy. A non-circular pin could be mounted through both the blade portion and blade housing. When the user loads the skate, the rotation of the blade portion relative to the blade housing causes the non-circular pin to twist, shear, and store mechanical energy. When the skate is unloaded, the pin will spring back to its original geometry which releases the mechanical energy to propel the user in the desired direction.

The effects of torsion and shear deformation on the pin will result in a pivoting motion of the blade portion about the center point of the pin. This design can easily be assembled and disassembled should maintenance be required. Furthermore, this design only requires a small number of parts to be manufactured, which results in a low cost for production.

Figure 7:
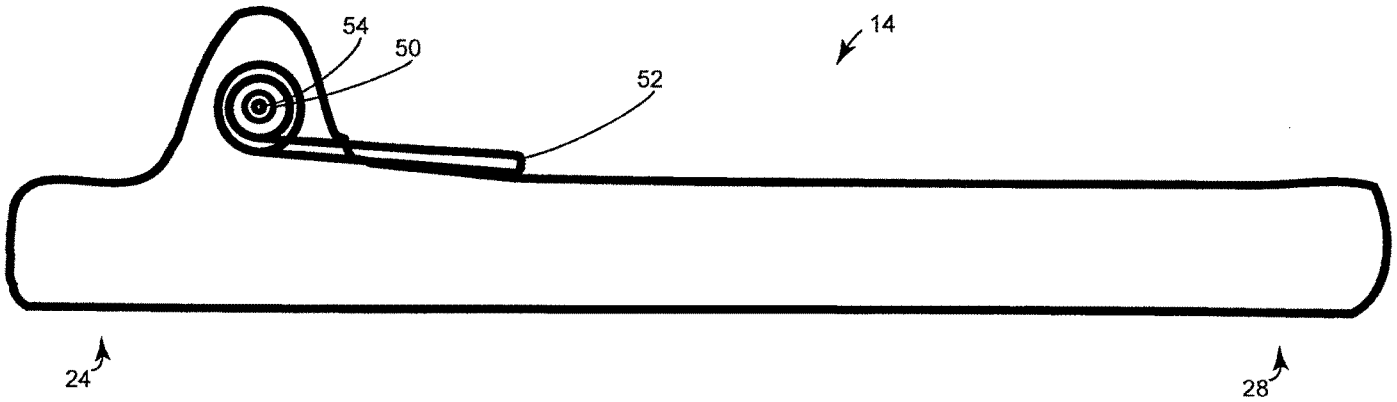
FIG. 7 is a schematic side view of a blade portion of the skate of FIG. 1 in accordance with another embodiment of the current disclosure.

Turning to FIG. 7, a further embodiment of a blade portion is shown. The current embodiment as shown in FIG. 7 may be referred to as a torsional spring embodiment. In this embodiment, the blade portion 14 includes hole 50 at the heel end 24 of the blade portion 14 for receiving or housing a torsional spring 52 and a fastener 54. The hole 50 may be seen as a torsional spring and pin joint. The torsional spring and pin joint 50 could be utilized to attach the blade portion 14 and the blade housing via the fastener 54. The torsional spring embodiment utilizes torsion and the coiling of the spring 52 to store mechanical energy when the skate is loaded. The setup would allow for a pivoting motion of the skate about the fastener. When the skate is loaded, the blade portion may pivot and the relative motion between the blade portion 14 and fastener will coil the torsional spring 52. When the skate is unloaded, the mechanical energy stored in the spring 52 will be provided back to the user as the spring uncoils.

One advantage of the torsional spring embodiment includes the benefit of being able to use different springs or to interchange different rated springs for different users.

Figure 8:
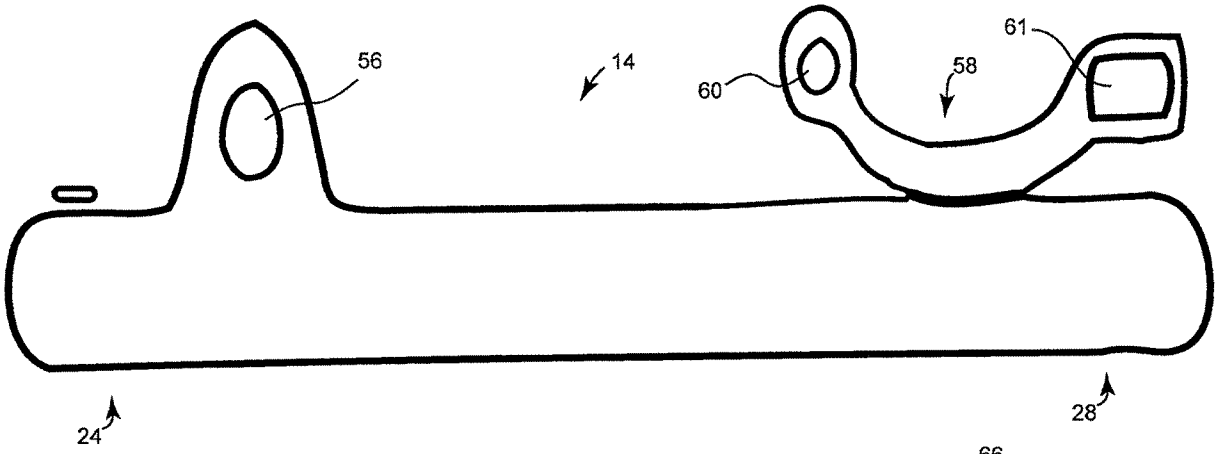
FIG. 8 is a schematic side view of a blade portion of the skate of FIG. 1 in accordance with a further embodiment of the current disclosure.

Turning to FIG. 8, another embodiment of a blade portion is shown. The current embodiment may be referred to as a leaf spring embodiment. The blade portion 14 includes a hole 56 at the heel end 24 through which the blade portion 14 may be fixed or integrated with the blade housing (not shown) via a fastener. The hole 56 may act as a pivot point when the skate is being used. At the toe end 28, a leaf spring 58 may be in contact with the blade portion 14. The leaf spring 58 includes a hole 60 which allows the leaf spring 58 to be connected or fastened to the blade housing and then rests on or is attached to a blade portion 14 at the bottom end and a slot 61 which may be used to assist in setting the equilibrium and maximum travel points setpoints to limit/customize vertical motion of the blade portion with respect to the blade housing. Although not shown, a pin or fastener can be placed through the hole 60 and slot 61 to assist in the setpoint control.

In a preferred embodiment, the leaf spring deflects and store mechanical energy when loaded and when the skate is unloaded, the leaf spring will spring back to its original position and the stored energy will be provided back to the user.

The advantages of this embodiment include that the blade can easily be removed by removing the fastener which is connected through the hole 56 in the heel end 24. The user can also remove the fasteners which connect the leaf spring to the blade housing in order to change the leaf spring if they prefer to use a leaf spring with a lower or higher rating.

Figure 9:
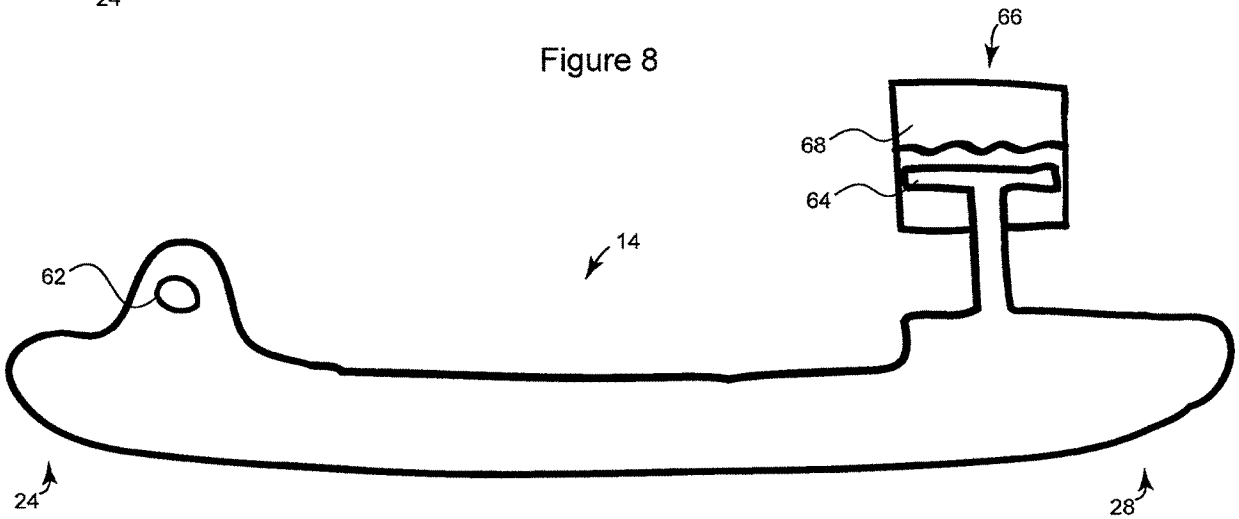
FIG. 9 is a schematic side view of a blade portion of the skate of FIG. 1 in accordance with another embodiment of the current disclosure.

Turning to FIG. 9, yet another embodiment of a blade portion is shown. The embodiment of FIG. 9 may be referred to as a compressible material chamber embodiment. The blade portion 14 includes a hole 62 at the heel end 24 which may be used to receive a fastener which allows the blade portion 14 to be fixed to or integrated with the blade housing.

As with other embodiments, the hole 62 may be seen as a pivot point for the skate blade system when the skate is in use. At the toe end 28 of the blade portion, a tab 64, which may be attached to the blade portion or integrated with the blade portion, extends from the blade portion 14 towards the blade housing into a chamber 66 containing a compressible material 68 such as any gas, liquid or solid. In a preferred embodiment, the chamber 66 is located within the blade housing. In operation, when the skate or blade portion is loaded, the material within the chamber is compressed.

When the skater loads the skate, the piston, or tab 64, which is engaged with the chamber 66 moves to decrease the volume of material 68 in the chamber 66, thus increasing the pressure of the contained material 68 within the chamber 66. When the skate is unloaded, the tab 64 lowers and the material 68 will return to an equilibrium pressure and the resulting change in pressure would increase the volume of the chamber. The increase in volume would in turn push the tab 64 which would push the blade portion of the skate, giving the user a propulsive force in the desired direction. One advantage of this system is that the initial equilibrium pressure level of fluid can be set to an appropriate pressure for each user.

Figure 12A:
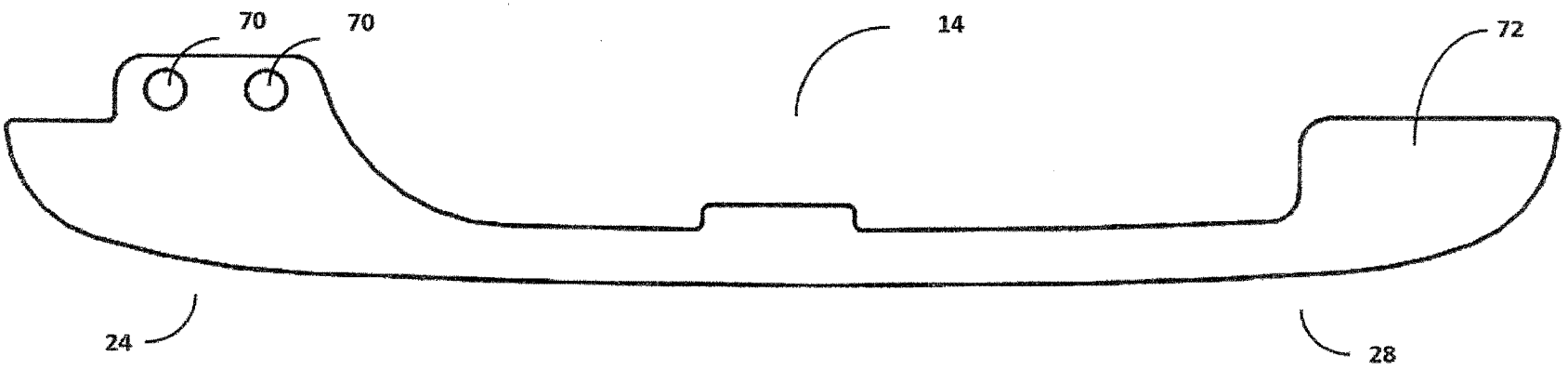
FIGS. 12*a* to 12*c* are schematic diagrams of a cantilever embodiment of a blade portion and blade housing.
Figure 12B:
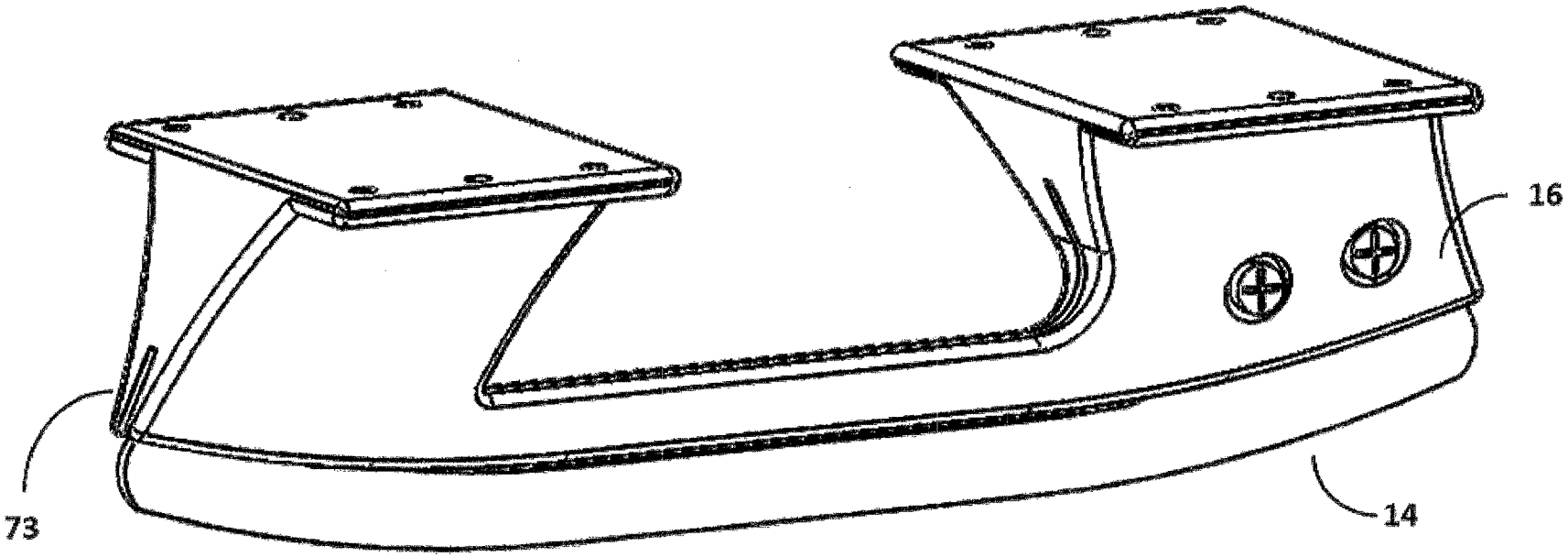
Figure 12C:
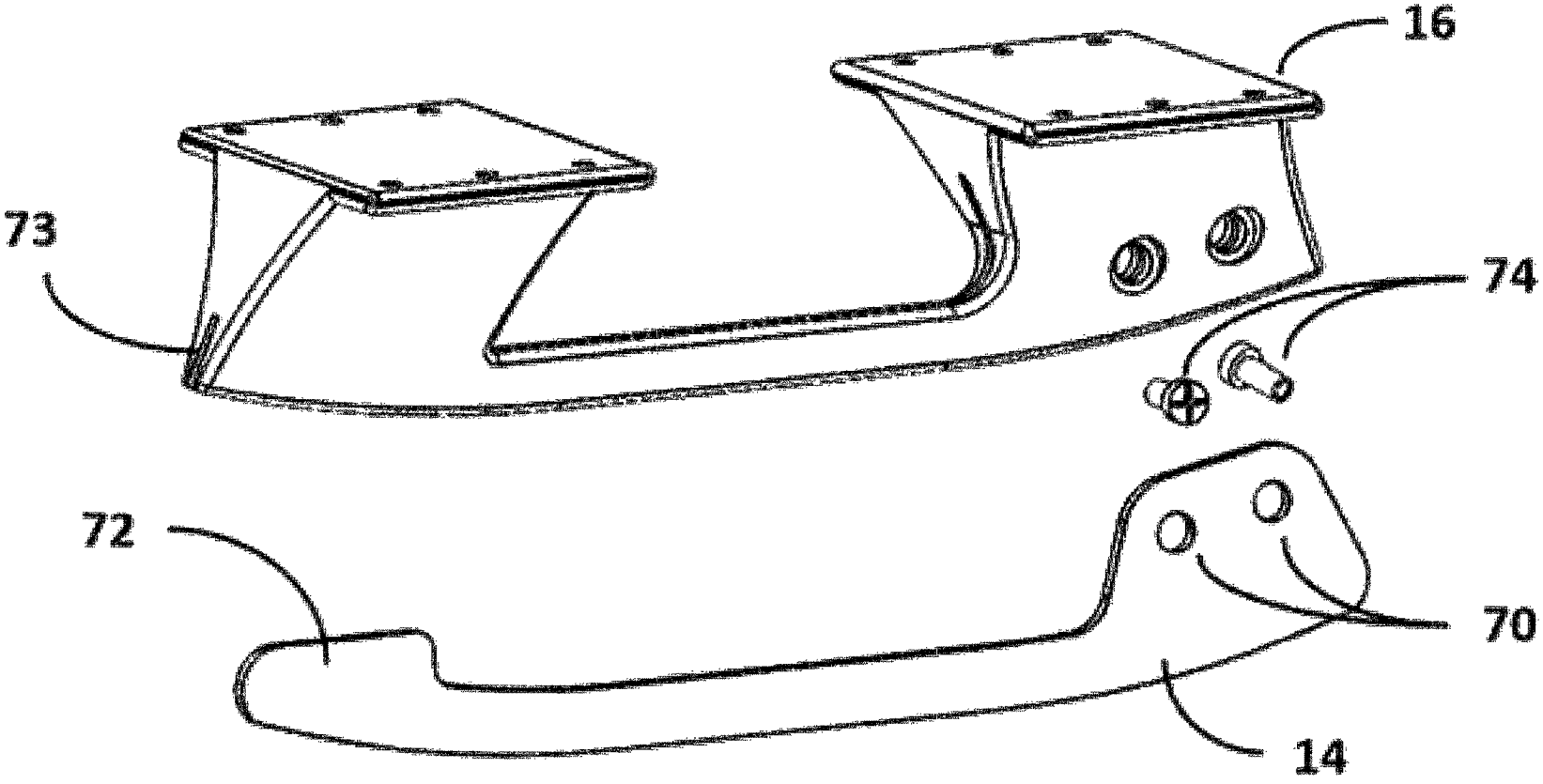

Turning to FIGS. 12*a* to 12*c*, schematic diagrams of a preferred embodiment of a skate blade system with dynamic movement is shown. The current embodiment may also be seen as a cantilever embodiment. Although the boot portion of the skate is not shown in FIGS. 12*a* to 12*c*, it will be understood that the boot portion is necessary to form the overall skate blade system.

In FIG. 12*a*, a side view of an example of a blade portion 14 for use in the cantilever embodiment is shown. The blade portion 14 includes a pair of through holes 70 located at the heel end 24 of the blade portion 14. In the current embodiment, a protrusion 72 is designed at the toe end 28 of the blade portion 14 to assist with the alignment between the blade portion 14 and a slot 73 within the blade housing 16 to maintain this spatial relationship (as shown in FIG. 12*b*).

The profile height of the blade portion may be adjusted in order to achieve the desired skate blade deflection and mass requirements for various users. As potential customers may weigh between 0-135 kg (0-300 lbs), different blade portions may be designed such that each blade will deflect a nominal amount when loaded to reduce impacts in the users joints and provide a propulsive force to the user. For example, if a light user was using a skate blade designed for much higher loadings, then the blade will not deflect very much and thus would not store as much energy.

For example, three different blade portions can be designed; one for users between 0-45 kg (0-100 lbs), another for users between 45-90 kg (100-200 lbs), and a third for users between 90-135 kg (200-300 lbs). These blade designs can be seen in the FIGS. 16*a* to 16*c* which are side views of various blade portion profiles which may be used depending on the weight of users with the blade portion of FIG. 16*a* for heavier skate users, the blade portion of FIG. 16*b* for average weighted skate users and the blade portion of FIG. 16*c* for lighter weighted skate users. Additional blade portion shapes may be created to decrease the weight ranges capacity of each blade portion. Furthermore, customized blades for particular individuals could also be created.

In assembly of the blade portion and the blade housing, the blade portion 14 is preferably attached to the blade housing 16 via a pair of threaded fasteners 74 (see FIG. 12*c*) which fit tightly within the through holes 70. FIG. 12*b* shows the blade portion 14 integrated with the blade housing 16 while FIG. 12*c* shows certain components in exploded view.

The cantilever embodiment allows the profile of the blade portion 14 to deflect and store mechanical energy when loaded. Through fixing the heel end 24 of the blade portion 14 to the blade housing 16, the entire length of the blade portion will deflect when loaded. The deflection of the beam or blade portion will be proportional to the cross sectional area, moment of inertia, and material properties of the blade. When the skate is unloaded the blade portion will spring back to its original geometry and the stored mechanical energy will be used to propel the user in the desired direction.

Further advantages of the cantilever embodiment include, but are not limited to, that the maintenance and serviceability of the components will be easy for the user. Through simply loosening a couple fasteners, the blade portion can be detached. The deflection of the blade can also be modeled in finite element method programs to estimate the blade deflection.

In a preferred embodiment, the blade portion for this cantilever embodiment has been designed to have similar amounts of secured surface area within the holder as current skate blades, however, the surface area will change as the blade height changes to accommodate for different users. Each of these blades preferably have a protruding portion at the toe end 28 which will allow to blade portion to remain secured in the slot 73 of the blade housing 16. Without this protruding portion extending into the blade housing, the blade portion may be susceptible to twisting and bending in the horizontal or lateral direction. Furthermore, this small protrusion 72 allows for the blade portion to remain aligned with the blade housing and will not shift laterally. The cantilever embodiment preferably includes an adequate amount of secured blade surface area within the blade housing to withstand anticipated loads in the lateral direction.

Figure 12D:
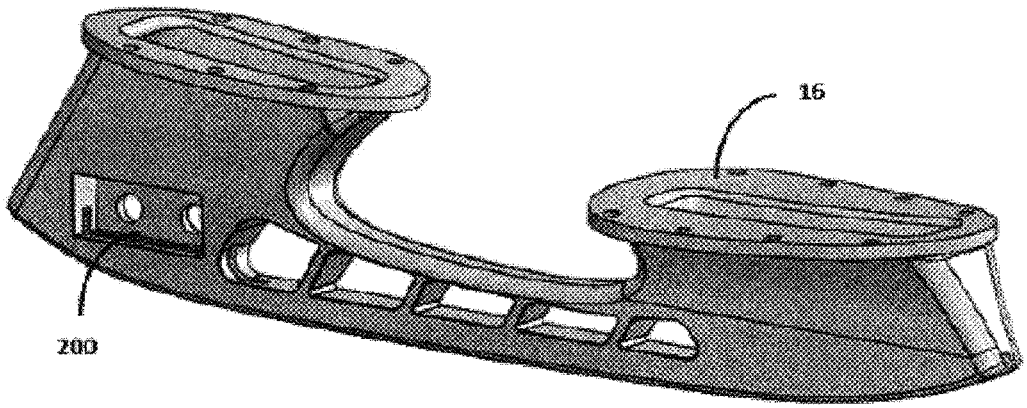
FIG. 12*d* is a perspective view of an alternative embodiment of a blade housing for use with the cantilever embodiment of FIGS. 12*a* to 12*c;*
Figure 12E:
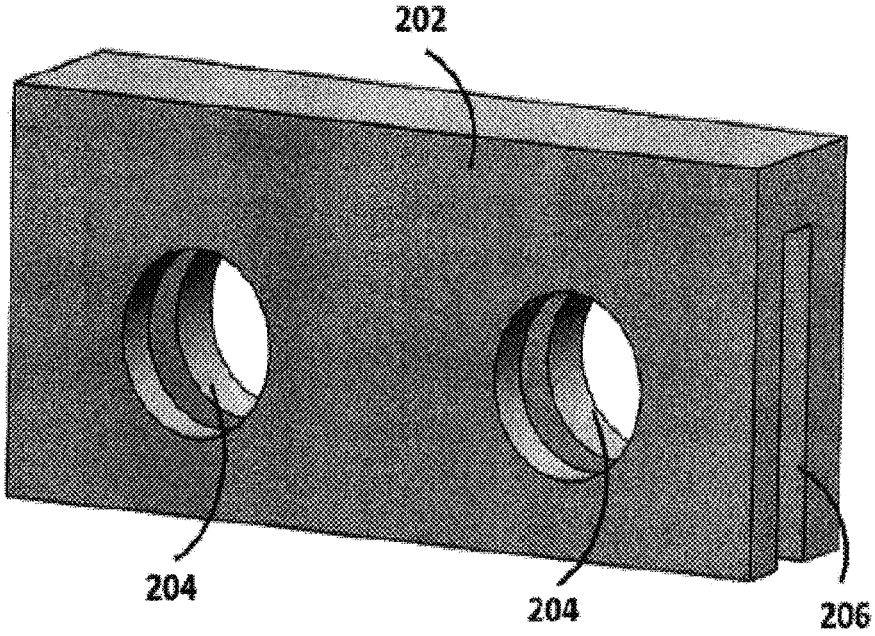
FIG. 12*e* is a perspective view of a fastener block for use with the blade housing of FIG. 12*d;*

FIG. 12*d* is a perspective view of another embodiment of a blade housing 16 for use with a cantilever embodiment. Within the blade housing 16 is a cut-out portion 200 for receiving a fastener block 202 (such as the one shown in FIG. 12*e*). As shown in FIG. 12*e*, the fastener block 202 includes a set of holes 204 for receiving fasteners and a slot 206 for receiving the blade portion. Therefore, the fasteners are not directly contacting the blade housing 16 when the blade portion 14 is fixed to the blade housing 16.

Figure 12F:
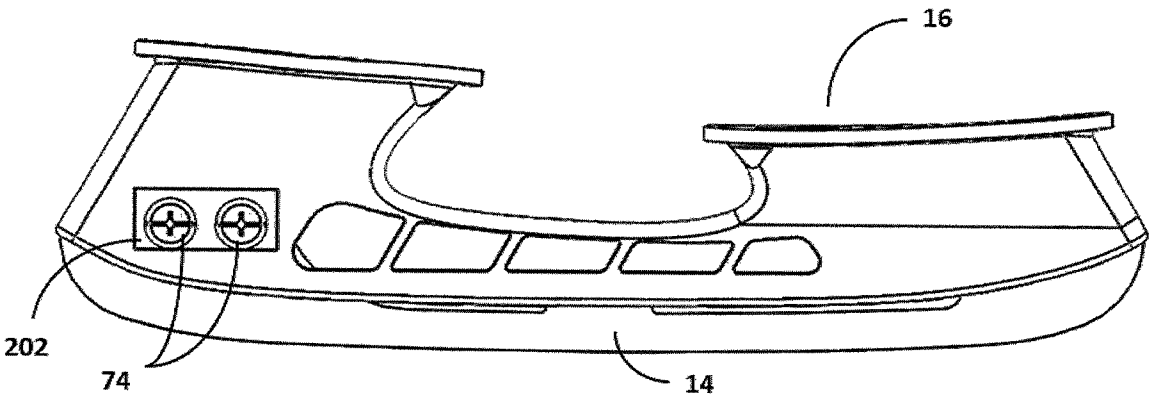
FIG. 12*f* is a side view of the blade housing of FIG. 12*d* with a fastener block.
Figure 12G:
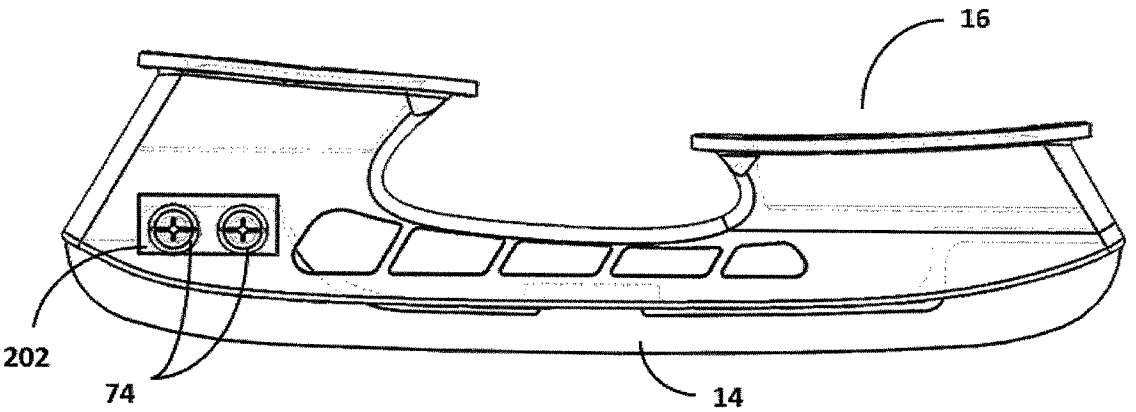
FIG. 12*g* is a side view of the blade housing of FIG. 12*f* with the blade portion outlined.

A side view of the fastener block 202 inserted into the blade housing 16 is shown in FIG. 12*f*. When the blade portion is inserted into the blade housing 16, the fastener block 202 receives the fasteners for the fixing of the blade portion within the blade housing 16. The inclusion of the fastener block 202 allows for an easier way to replace fasteners and to extend the life of blade housings. For instance, if there is wear and tear in the hole 70 of the embodiment of FIG. 12*a*, the entire blade housing may need to be replaced. In the current embodiment, if there is wear and tear in the hole 202, only the fastener block 202 needs to be replaced. FIG. 12*g* is a side view of the blade housing of FIG. 12*d* with the blade portion outlined.

Figure 13A:
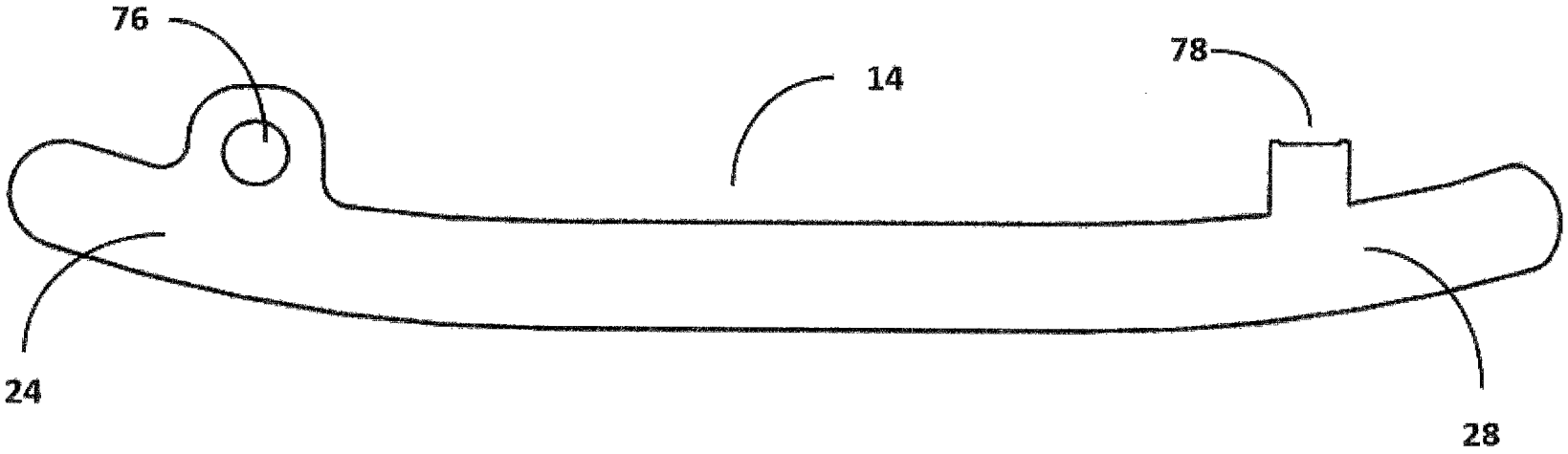
FIGS. 13*a* to 13*e* are schematic diagrams of a spring mechanism embodiment of a blade portion and blade housing.
Figure 13B:
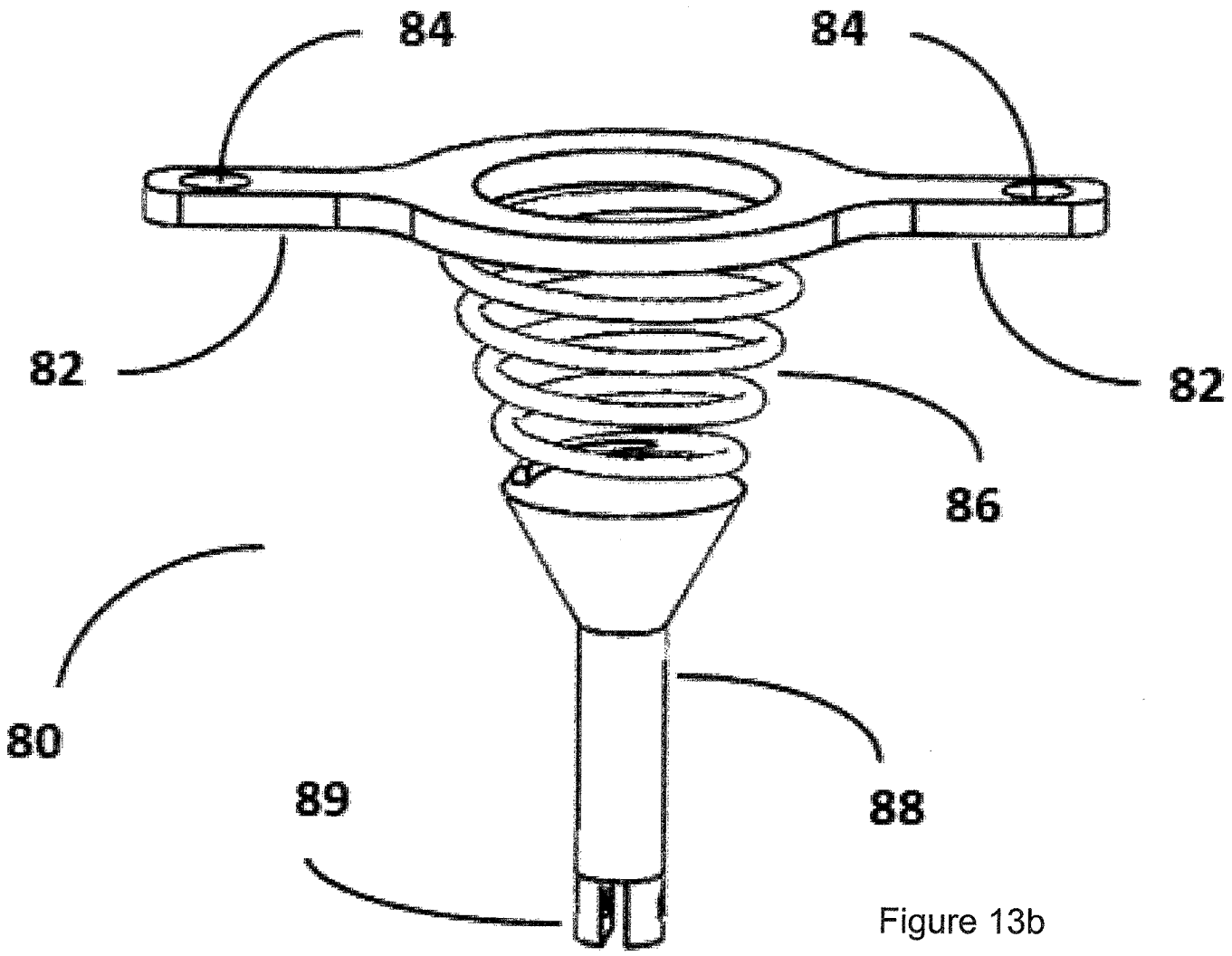
Figure 13C:
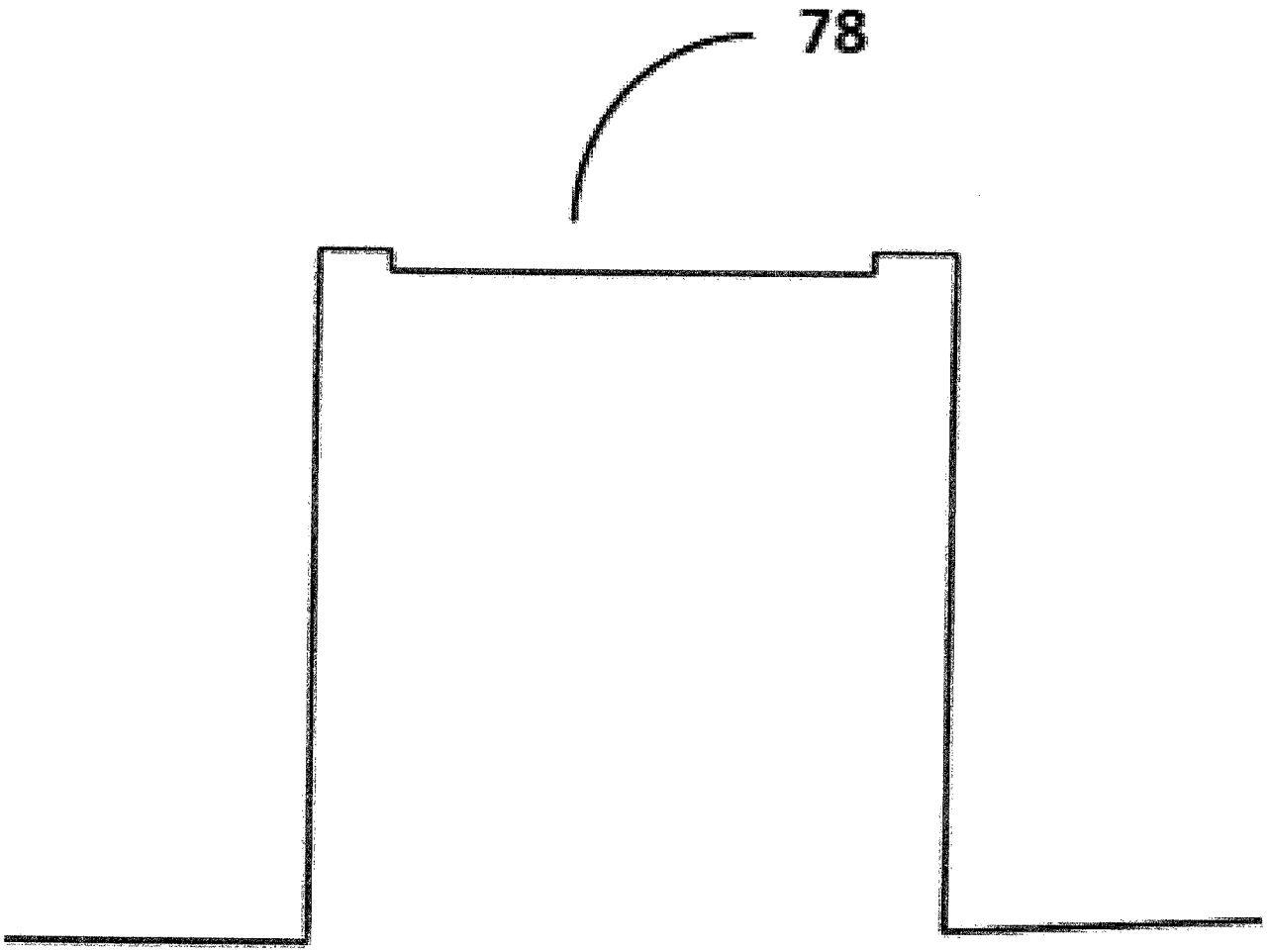
Figure 13D:
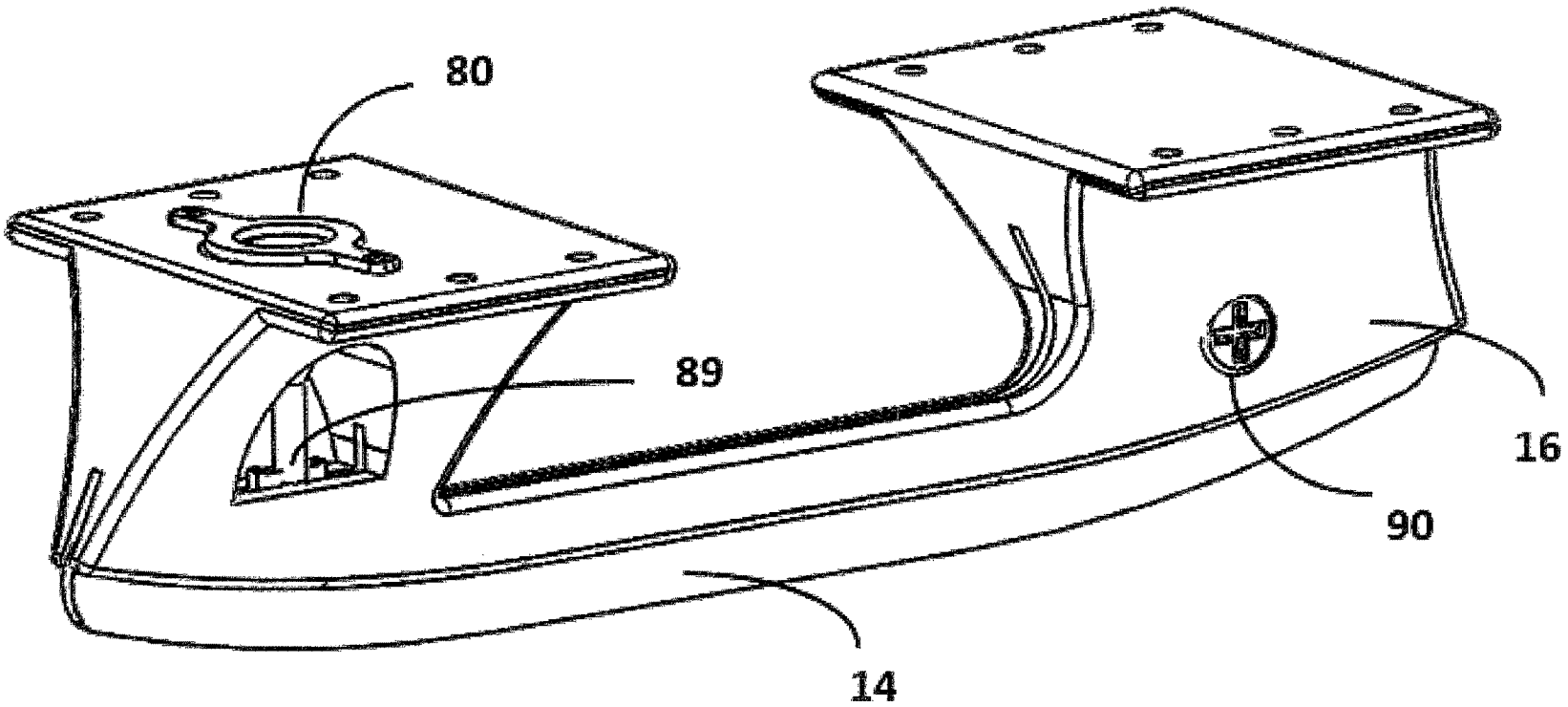
Figure 13E:
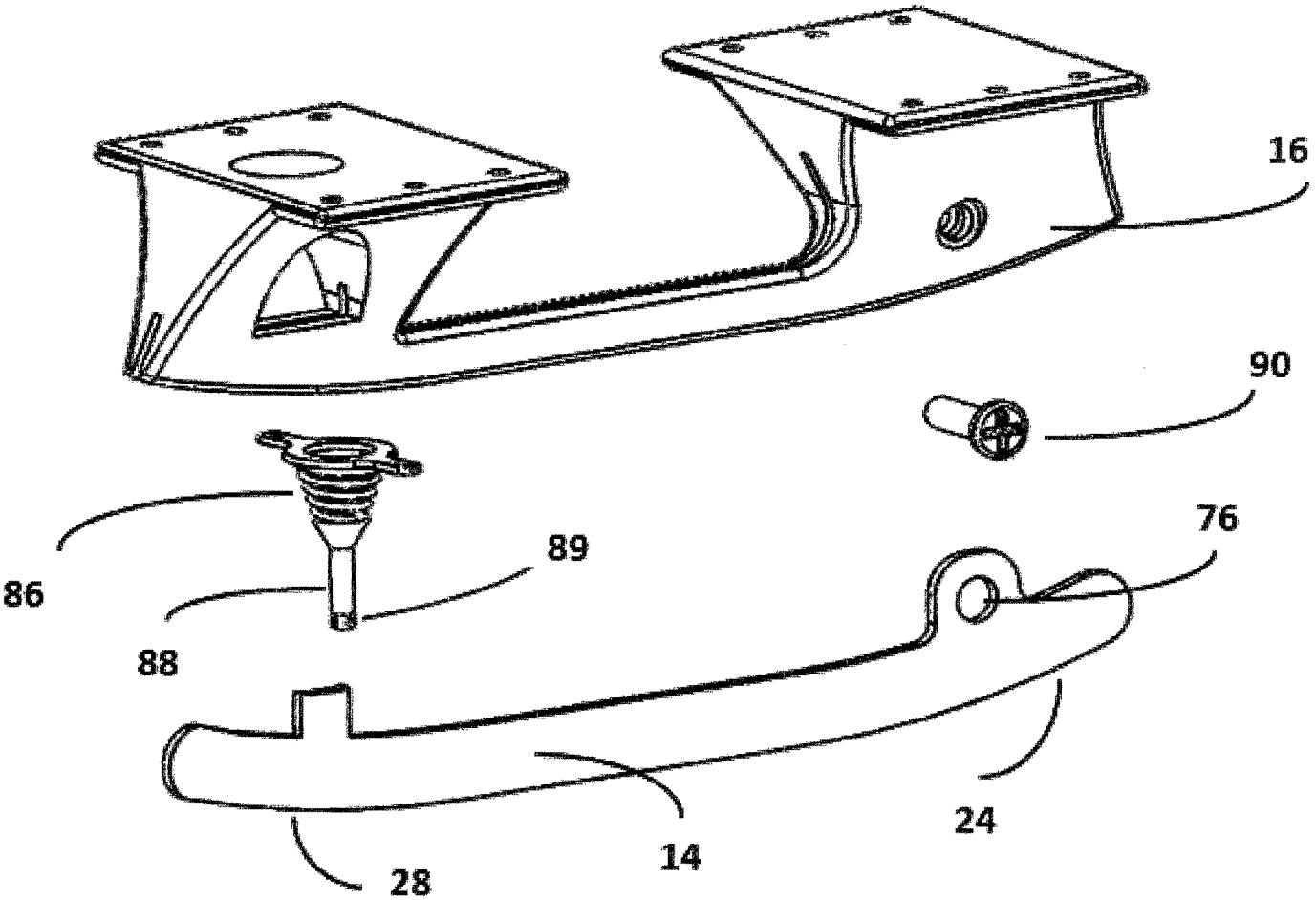

Turning to FIGS. 13*a* to 13*e*, yet a further embodiment of a skate blade system with dynamic movement is shown. FIG. 13*a* is a schematic diagram of a blade portion, FIG. 13*b* is a schematic diagram of a spring mechanism, FIG. 13*c* is an enlarged view of a protrusion located at a toe end of the blade portion, FIG. 13*d* is a perspective view of the blade housing and blade portion assembled and FIG. 13*e* is an exploded view of FIG. 13*d*. As understood, the boot portion is not shown, however the boot portion (such as shown in FIG. 1) will form part of the skate blade system.

As shown in FIG. 13*a*, the blade portion 14 includes a hole 76 located at the heel end 24 and a protrusion, or attachment mechanism, 78 at the toe end 28. As shown in FIG. 13*d*, a spring mechanism 80 (such as the one shown in FIG. 13*b*), is located within the blade housing 16 and includes a pair of tabs 82 having holes 84 which allow the spring mechanism 80 to be mounted or fastened to the blade housing 16. The spring mechanism 80 further includes a spring portion 86 and an extension portion 88. As shown in FIG. 13*d*, the extension portion 88 includes a blade portion mounting section 89 which mates or abuts the protrusion 78 on the blade portion 14 within the blade housing 16. The spring portion 86 sits atop a top portion of this blade portion mounting section 89. The blade portion 14 is fixed to or integrated with the blade housing via a fastener 90 in the hole 76.

Current blade housings gradually increase in width as they continue upwards from the blade portion towards their connection point to the boot portion. Due to this tapered geometry, the spring mechanism 80 may require an attachment (such as the extension portion 88) to connect the blade portion 14 with the spring portion 86. This will allow the spring portion 86 to be mounted closer to the boot portion where more space is available.

In one specific embodiment, which is not meant to be narrowing with respect to the overall scope of the disclosure, the blade portion could be attached to the blade housing with a threaded fastener fastened through the hole 76 at the heel end. At the toe end, the extension portion 88 engages with the blade portion 14. The spring mechanism which houses the spring could be riveted along with the housing to the bottom of the boot portion to ensure it is securely fixed.

In other embodiments, different springs with different spring ratings or spring sizes could be utilized (potentially with different adaptor sizes to house and attach the spring portion). Furthermore, in order to withstand the anticipated loads in the axial and transverse directions, for both the cantilever and spring mechanism embodiments (FIGS. 12 and 13), the blade portion 14 is preferably securely constrained by the blade housing 16. Current blade housings have a slotted channel, which allows for a tight fit between the blade portion and blade housing which may be employed in embodiments of the disclosure. This tight fit preferably maintains the skate blade within the blade housing such that the blade portion does not laterally shift inside the blade housing. Therefore, in both the cantilever and spring mechanism embodiments, these skate blade system preferably has a similar amount of secured surface area such that the lateral and transverse forces can be withstood.

Although designed for use with ice skates, the spring model chosen is also applicable to figure skates, roller skates, Rollerblades™, which could utilize the same blade holder integrated with wheels.

Figure 14A:
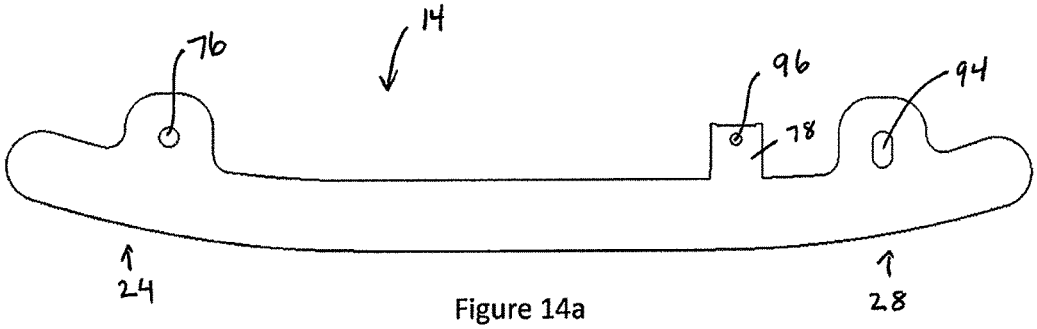
FIG. 14*a* is a side view of a further embodiment of a blade portion.
Figure 14B:
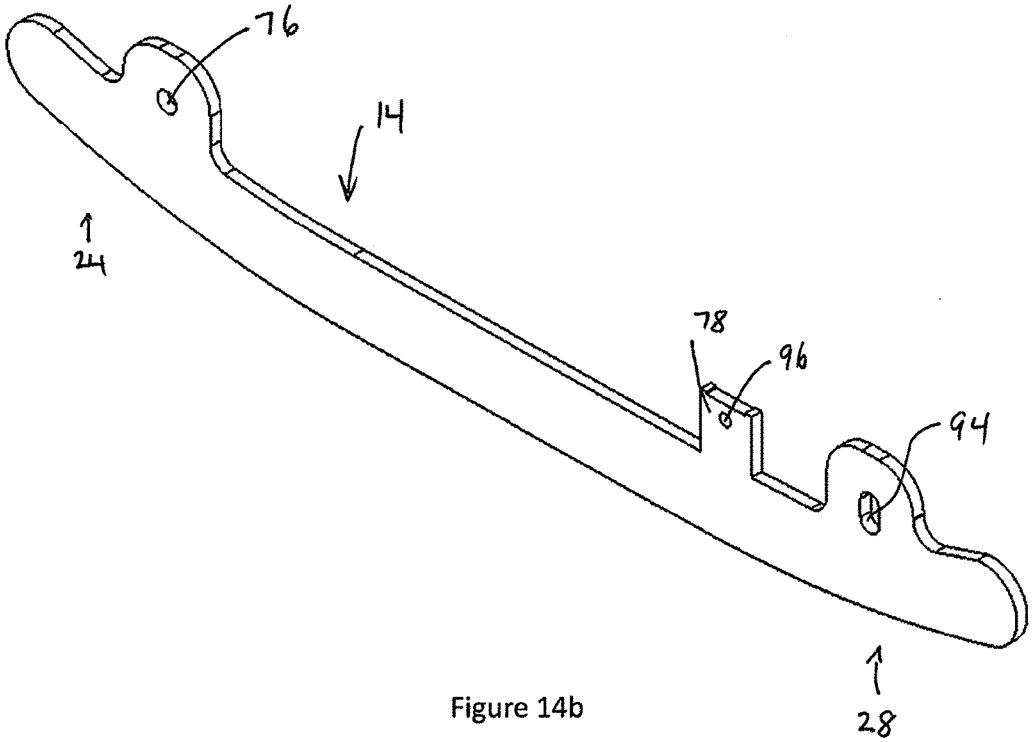
FIG. 14*b* is a perspective view of the embodiment of FIG. 14*a;*

Turning to FIGS. 14*a* and 14*b*, yet another embodiment of a blade portion for use with a spring mechanism embodiment is shown. Unlike the blade portion of FIGS. 13*a* to 13*e*, the blade portion of the current embodiment includes a second hole 94 located at the toe end 28 and a third hole 96 located on the protruding region 78. The second hole 94 may act as a guiding component. Through placing a fastener through the guiding hole 94, the upper and lower travel set points of the blade portion may be established. The blade portion may rotate about the pivot point at hole 76 located at the heel end 24, and can move vertically at the toe end 28, by a distance limited by the guiding hole 94. The third hole 96 can act as an attachment mechanism for the spring mechanism 80, specifically for better securing the extension portion 88.

Figure 14C:
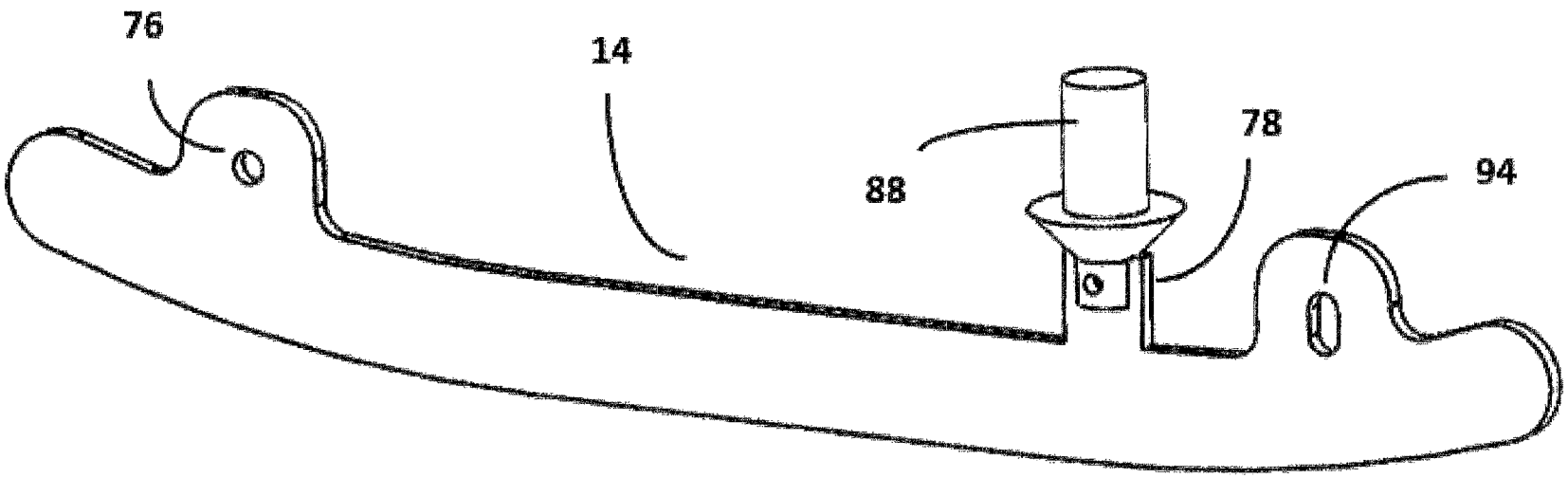
FIG. 14*c* is a perspective view of the embodiment of FIG. 14*a* with an extension portion mounted.
Figure 14D:
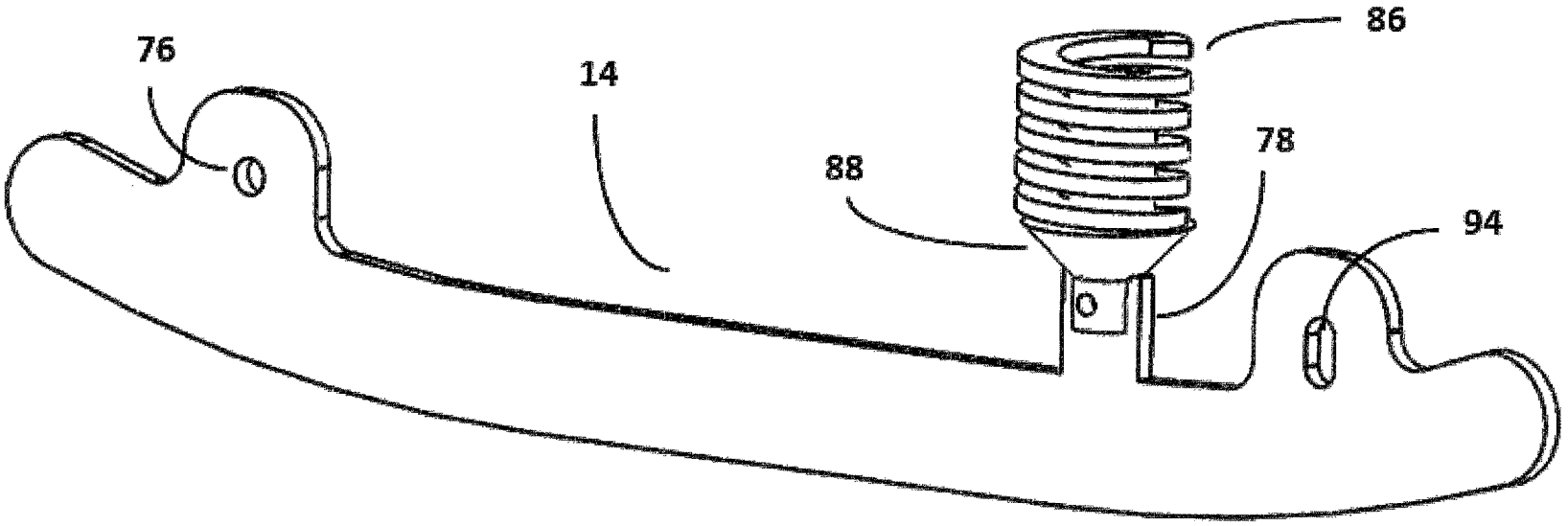
FIG. 14*d* is a perspective view of the embodiment of FIG. 14*a* with an extension portion and spring mounted.
Figure 14E:
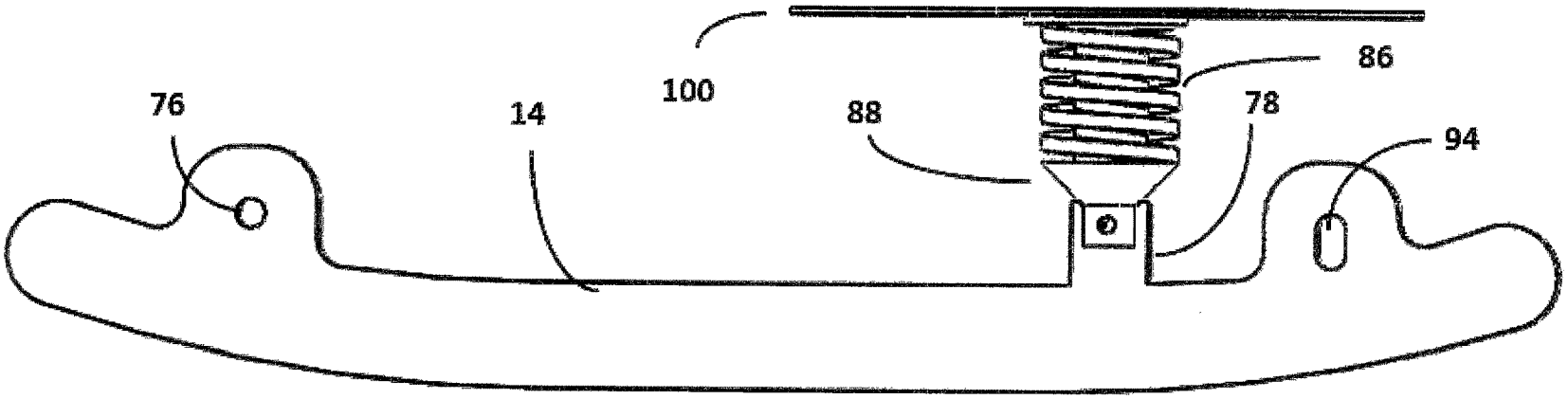
FIG. 14*e* is a side view of the embodiment of FIG. 14*a* with an extension portion, spring and plate mounted.
Figure 14F:
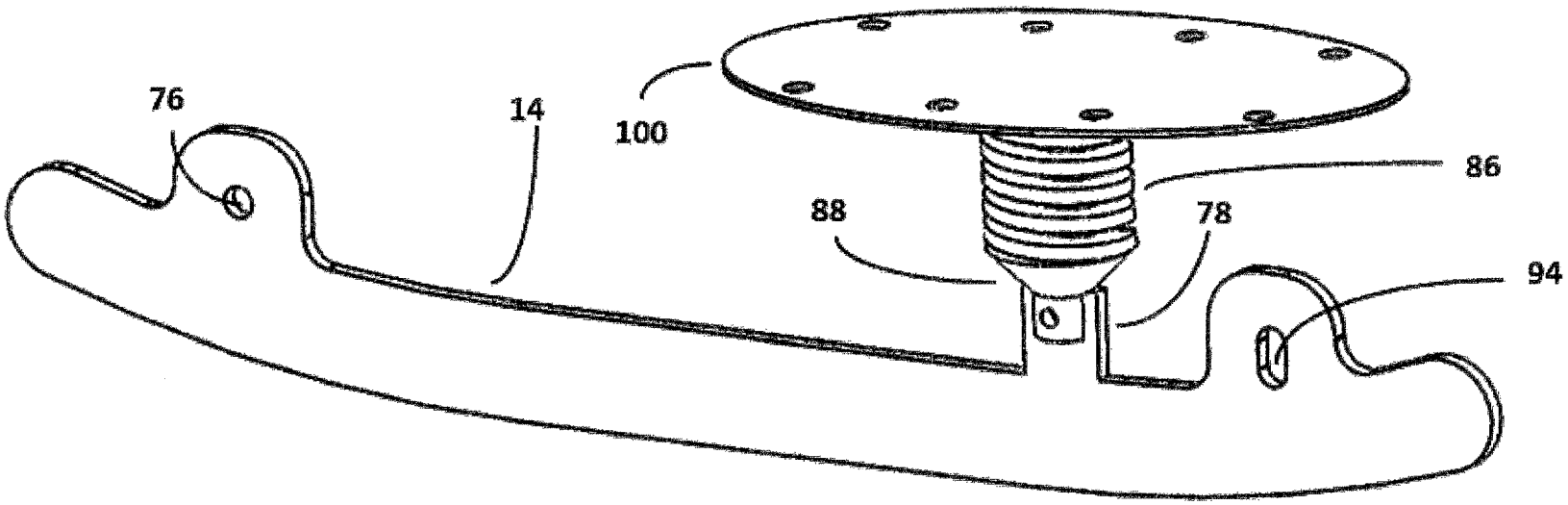
FIG. 14*f* is a perspective view of the blade portion of FIG. 14*e;*
Figure 14G:
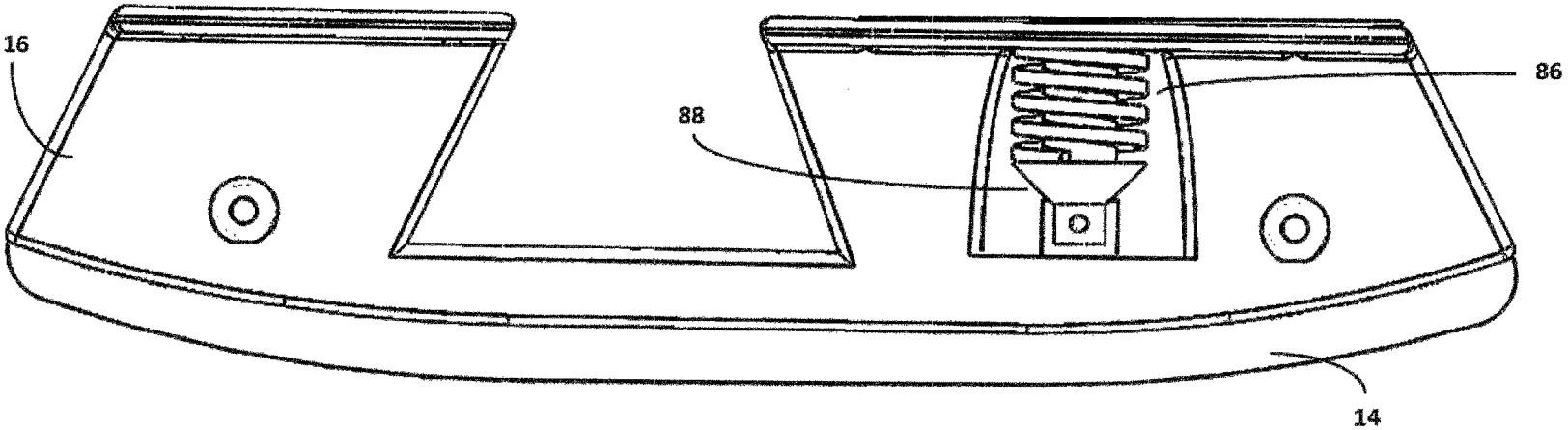
FIG. 14*g* is a side view of a spring mechanism embodiment with a cut out portion for viewing purposes.
Figure 14H:
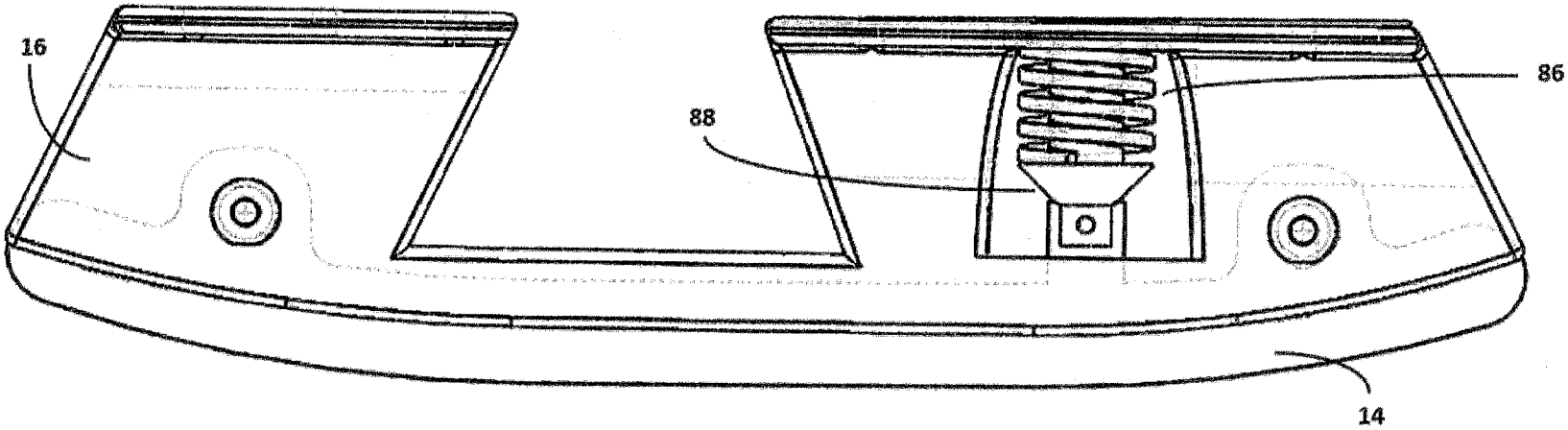
FIG. 14*h* is a side view of a spring mechanism embodiment with a cut out portion for viewing purposes and the blade portion outlined.

FIG. 14*c* is a perspective view of a blade portion 14 with the extension portion 88 mounted. FIG. 14*d* is a perspective view of the blade portion having a spring 86 and extension portion mounted. FIG. 14*e* is a side view of the blade portion having a spring 86, extension portion and plate mounted while FIG. 14*f* is a perspective of FIG. 14*e*. As shown in FIGS. 14*e* and 14*f*, the spring mechanism 80 includes a plate portion 100 (which is mounted to a bottom of the boot portion) and a spring 86 which surrounds an adapter or extension portion 88 (partially hidden by the spring 86) which abuts the protrusion 78 of the blade portion 14. The spring 86 and the adapter portion 88 are preferably housed within the blade housing (such as shown in, for example, FIGS. 14*g* and 14*h* where FIG. 14*g* is a side view of a blade housing and blade portion attached with a cut out portion showing the spring mechanism). FIG. 14*h* is similar to FIG. 14*g* with a blade portion outlined.

The dynamic nature and operation of the spring mechanism and therefore the skate is described above with respect to FIGS. 13*a* to 13*e*.

Figure 17:
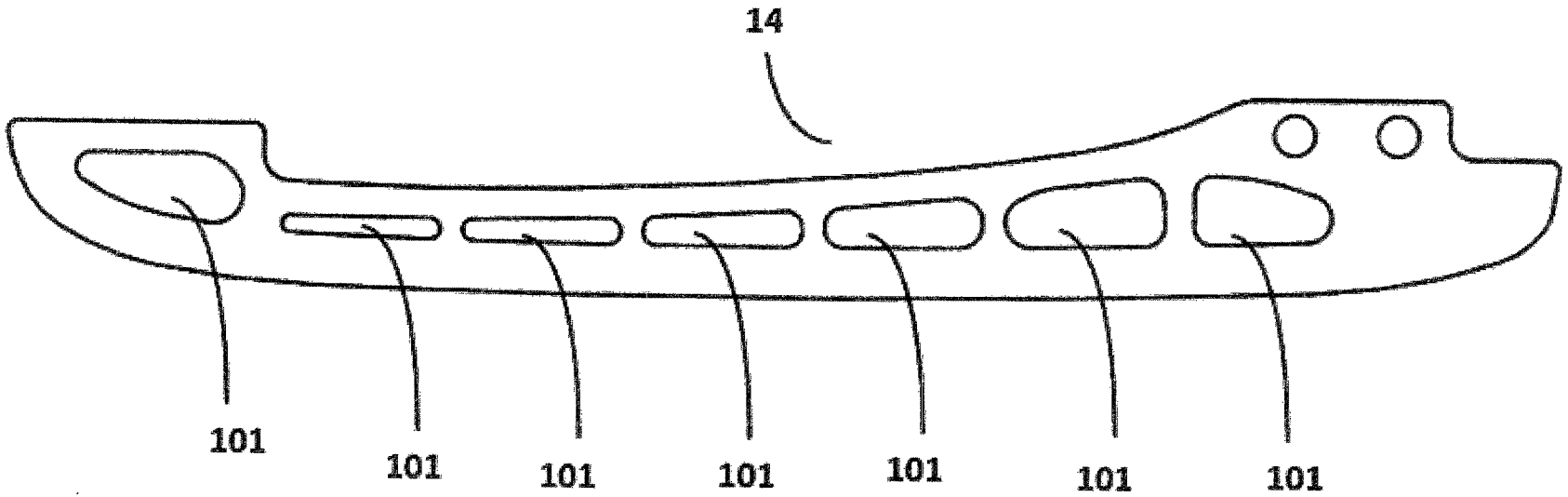
FIG. 17 is a schematic diagram of another embodiment of a blade portion.

FIG. 17 is a schematic diagram of another embodiment of a blade portion whereby the blade portion 14 includes cutout or hole portions 101 which allow the weight of the blade portion 14 to be reduced.

In general, to improve skate dynamics, It is advantageous for the skate blade system of the disclosure to increase the amount of contact time in which the blade portion is on the ice as seen in the Linear Impulse of Momentum equation below.

$$\int_{t1}^{t2} \text{Force}*dt = \text{Mass}*\Delta\text{Velocity}$$

Through increasing dt (the duration of time in which the blade portion is in contact with the ice), increases in the user's change in velocity will be obtained, allowing them to accelerate faster and reach higher maximum speeds.

The motions in skating and running are very similar and result in comparative forces in the individual's body. Studies have proven that the repeated impact forces on a runner's foot can reach three times their body weight. The accelerometer data depicted that the maximum absolute acceleration of the skater was 25 $m/s^2$. It is expected that high caliber and professional hockey players could accelerate up to 30 $m/s^2$, which would generate impact forces approximately three times their body weight. Note that the accelerometer was located at the skater's sternum to accurately approximate their centre of gravity.

In order to determine a maximum repeated force which a skate or blade portion would need to withstand, the maximum acceleration of a skater would need to be multiplied by the maximum weight of the skater as shown through Newton's Second Law below.

$$\text{Force} = \text{Mass}*\text{Acceleration}$$

For a skater that weighs approximately 125 kg, multiplying the maximum expected mass of 125 kg by the maximum expected acceleration of 30 $m/s^2$ one can determine that a skate will have to endure repeated loads of 3750N.

In this case, for the cantilever embodiment, blade deflection can be found through finite element analysis due to the abnormal blade geometry. In some experiments, the finite element simulations predicted the needed clearance between the top of the blade portion and the bottom of the blade housing along the length of the blade portion. Hand calculations for a constant cross section cantilever beam were also performed to get a rough deflection estimate and can be seen in the Figures. A strength analysis of the fasteners and the blade housing were also conducted to determine the safety factor from shearing, bending, and bearing failure.

Figure 15:
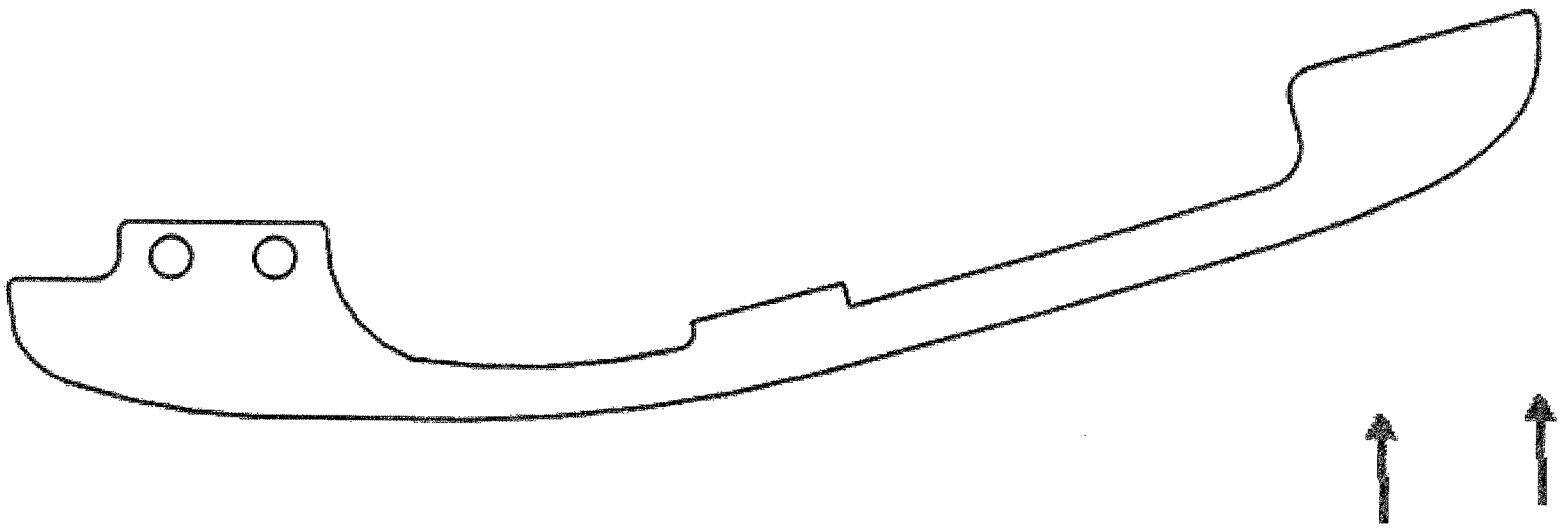
FIG. 15 is a finite element analysis of a blade portion for a cantilever embodiment.

Finite element analysis was conducted to observe the maximum stresses and amount of deflection in the cantilever blade profile. The profile of a blade portion for use in the cantilever embodiment was fixed and a load was applied at the tip of the blade portion. As can be seen, the maximum stresses were located at the filleted region where the blade increases in area to allow for the fasteners to connect it to the holder. The fillet could be adjusted to save weight, while at the same time ensuring that the maximum stresses are below the material's yield strength. The finite element analysis is shown in FIG. 15.

For the spring mechanism embodiment, it is desired that the spring mechanism does not deflect such that the user is unable to remain balanced and skate securely. Too much deflection may require longer adaptive periods for the user due to the increased instability. The selected spring should also fit into the blade housing without needing to modify the housing to reduce the cost of manufacturing a skate and also so that this skate blade system with dynamic movement may be fitted into existing skates. Note that the spring material could be longer if it were smaller in diameter or shorter if it were wider in diameter.

In order to determine a preferred spring, fatigue failure and energy calculations were performed on the spring. The maximum spring energy storage was calculated to be 4.7 J based off a 5.1 mm deflection at a 1855N applied load. The stresses experienced during the dynamic loading of 1855N will allow for infinite spring life.

Furthermore, with respect to the spring mechanism embodiment, individual components for each mechanism were selected from different options. For the spring mechanism, there are various components that can be chosen as fasteners for the blade portion and the blade housing, fasteners for the blade housing and the boot portion, and various types and materials of springs can be used.

In other words, the fasteners for fastening the blade portion to the blade housing via the hole may be a nut and bolt combination, a fastener or a hinge. The apparatus for mounting the blade housing to the bottom of the boot portion may be accomplished via a rivet, a set of screws or adhesives. Finally, the material for the spring may preferably be selected from a metallic spring, a non-metallic spring, a compressible material or a piece of polymer which has spring-like properties.

In the preferred embodiment, the spring mechanism embodiment uses a chrome-silicone closed and ground steel spring, blind hole screw fasteners, and rivet connectors.

The above-described embodiments are intended to be examples only. Alterations, modifications and variations can be effected to the particular embodiments by those of skill in the art without departing from the scope, which is defined solely by the claims appended hereto.

What is claimed is:

1. A skate blade system comprising:

a boot portion;

a blade housing, mounted to a bottom of the boot portion, the blade housing having a slot; and a blade portion having a first and a second end;

wherein the blade portion is positioned within the slot and is fastened at either the first end or the second end to the blade housing in a cantilever, fixed relationship and is not engaged in fixed relationship with the blade housing at the other end such that an unfixed portion of the blade portion flexes and stores mechanical energy when the skate is loaded within the blade housing when loaded and when unloaded the unfixed portion of the blade portion springs back to its original position and the stored mechanical energy propels the user in a desired direction.

2. The skate blade system of claim 1 wherein the blade portion further comprises a protrusion.

3. The skate blade system of claim 2 further comprising a spring mechanism integrated with the blade housing, the spring mechanism, including a spring which abuts the protrusion in a rest position.

4. The skate blade system of claim 3 wherein the spring mechanism further comprises apparatus for mounting the spring mechanism to the blade housing.

5. The skate blade system of claim 2 wherein the spring mechanism further comprises: a plate mounted to a bottom of the blade housing; and an extension portion mounted between the plate and the blade portion.

6. The skate blade system of claim 5 wherein the extension portion comprises a blade portion mounting section.

7. The skate blade system of claim 6 wherein a bottom of the spring abuts a top of the blade portion mounting section.

8. The skate blade system of claim 2 wherein the blade housing includes a slot for receiving the protrusion.

9. The skate blade system of claim 1 further comprising:

a fastener block.

10. The skate blade system of claim 9 wherein the fastener block is integrated with the blade housing to receive fasteners for fastening the blade portion to the blade housing.

11. The skate blade system of claim 10 wherein the fastener block further comprises a slot for receiving the blade portion.

12. The skate blade system of claim 9 wherein the blade housing further comprises:

a cut out portion for receiving the fastener block.

13. The skate blade system of claim 1 wherein the blade portion comprises:

apparatus for controlling equilibrium setpoints.

14. The skate blade system of claim 1 wherein the blade portion comprises:

apparatus for controlling movement setpoints.

15. The skate blade system of claim 1 further comprising:

a set of fasteners for attaching the blade portion to the boot portion.

16. The skate blade system of claim 15 wherein the blade portion further comprises:

a set of holes for receiving the set of fasteners.

17. The skate blade system of claim 1 wherein the blade portion further comprises a set of protrusions or holes along a length of the blade portion to enable attachment of the blade portion to the blade housing.

18. The skate blade system of claim 17 wherein the blade housing includes a slot for receiving the set of protrusions or holes.

* * * * *